US005591069A

United States Patent [19]

Wurthman

[11] Patent Number: 5,591,069

[45] Date of Patent: Jan. 7, 1997

[54] PORTABLE BLADE SHARPENER FOR ICE SKATES

[76] Inventor: Michael H. Wurthman, 30387 Conifer Mt. Dr., Conifer, Colo. 80433

[21] Appl. No.: 339,399

[22] Filed: Nov. 14, 1994

[51] Int. Cl.[6] ..... B24B 7/00

[52] U.S. Cl. ..... 451/241; 451/193; 451/72

[58] Field of Search ..... 451/72, 188, 193, 451/241, 545; 76/83, 88; 125/11.02

[56] References Cited

U.S. PATENT DOCUMENTS

| | | | |
|---|---|---|---|
| 3,007,287 | 9/1959 | Esopi | 451/241 |
| 3,125,833 | 3/1964 | Wilde | 51/102 |
| 3,164,932 | 1/1966 | Morith | 51/170 |
| 3,461,623 | 8/1969 | Koehnlein et al. | 51/241 |
| 3,789,551 | 2/1974 | Norris et al. | 51/92 |
| 3,812,626 | 5/1974 | Thompson | 51/170 |
| 3,827,185 | 8/1974 | Smith | 451/72 |
| 3,841,030 | 10/1974 | Laszlo | 51/170 |
| 3,881,280 | 5/1975 | Thompson | 51/102 |
| 4,219,975 | 9/1980 | Scholler | 51/205 |
| 4,271,635 | 6/1981 | Szalay | 451/241 |
| 4,615,144 | 10/1986 | Peacock et al. | 51/5 |
| 4,756,125 | 7/1988 | Kadnar | 451/241 |
| 5,127,194 | 7/1992 | Jobin | 451/193 |
| 5,189,845 | 3/1993 | Courchesne | 51/205 |
| 5,441,449 | 8/1995 | Hart | 451/72 |

OTHER PUBLICATIONS

Edge care, sales brochure for Edgecare Mark III.
E–Z Sharp, sales brochure for E–Z Sharp blade sharpening machines.
Wissota Mfg. Co., Sales brochure for Wissota Model 911 skate sharpener.
Fleming Gray Ltd., Sales brochures.
New England Sports Sales, Inc., Sales brochure.
Guspro, Inc., Sales brochure for Blademaster.

*Primary Examiner*—D. S. Meislin
*Assistant Examiner*—Dona C. Edwards
*Attorney, Agent, or Firm*—Dorr, Carson, Sloan & Birney, PC

[57] ABSTRACT

An improved ice skate blade sharpening system utilizing a powered rotating grinding wheel. The system has an adjustable guide for preventing canting and twisting of the blade as it is sharpened, and applies a constant cutting pressure to the edge irrespective of the force applied to the skate by the operator. The system also has a dressing mechanism utilizing a diamond-tipped stylus to maintain the proper curvature of the grinding wheel. The grinding wheel has a central plane perpendicular to the rotational axis, and is mounted to a drive shaft of an electric motor attached to a sliding block biased toward a first position by springs. The guide includes two opposing bearing surfaces spaced a distance apart and a mechanism for adjusting the distance between the bearing surfaces. The central plane of the grinding wheel lies between the bearing surfaces.

19 Claims, 13 Drawing Sheets

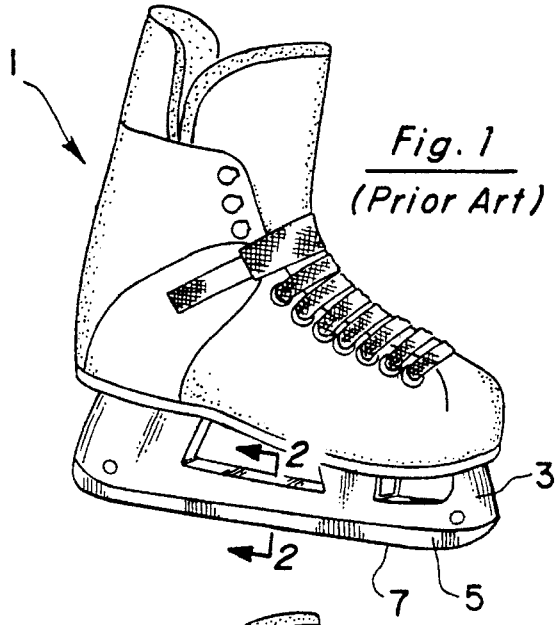
Fig. 1
(Prior Art)
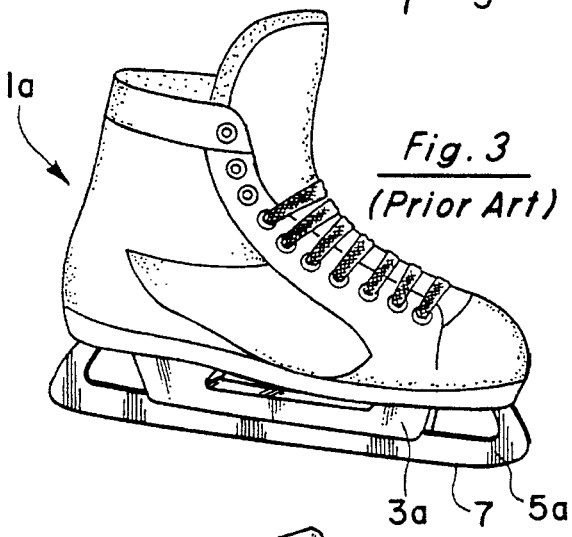
Fig. 3
(Prior Art)
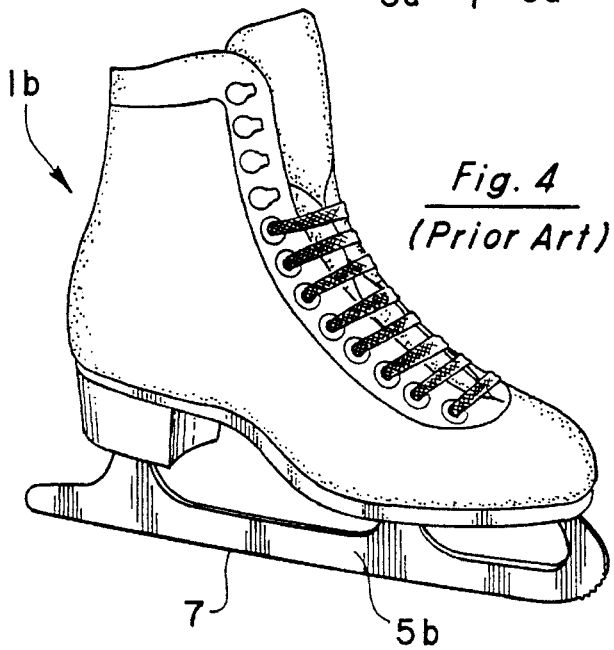
Fig. 4
(Prior Art)
Fig. 2
(Prior Art)
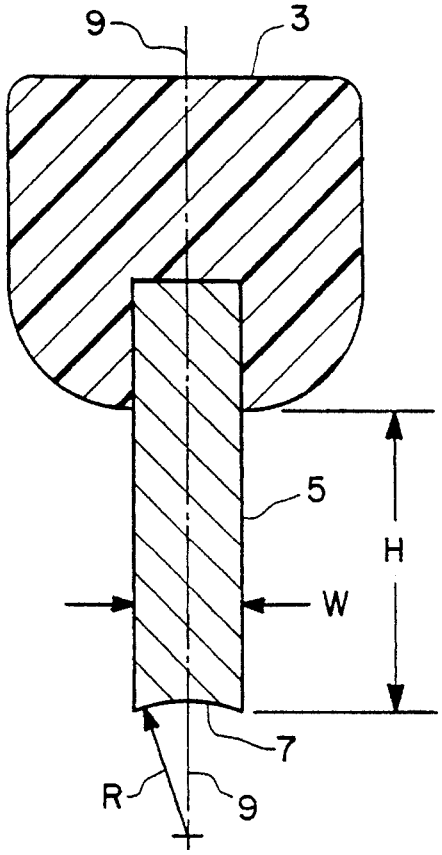
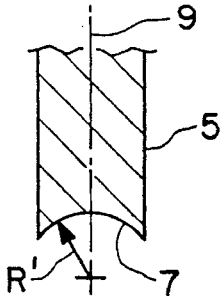
Fig. 2a
(Prior Art)

3
5
9
15
17
19
21
47
49
51
53
55
57
58
58a
58b
60a
60b
61
62
63
64
67
69
71
72
73
74
75
77
79
87a
87b
91
93
94
97
104
105
107
111
121
123
126
127
131
133
153
173
191
193
W2
D3
Bu
Bs
BL

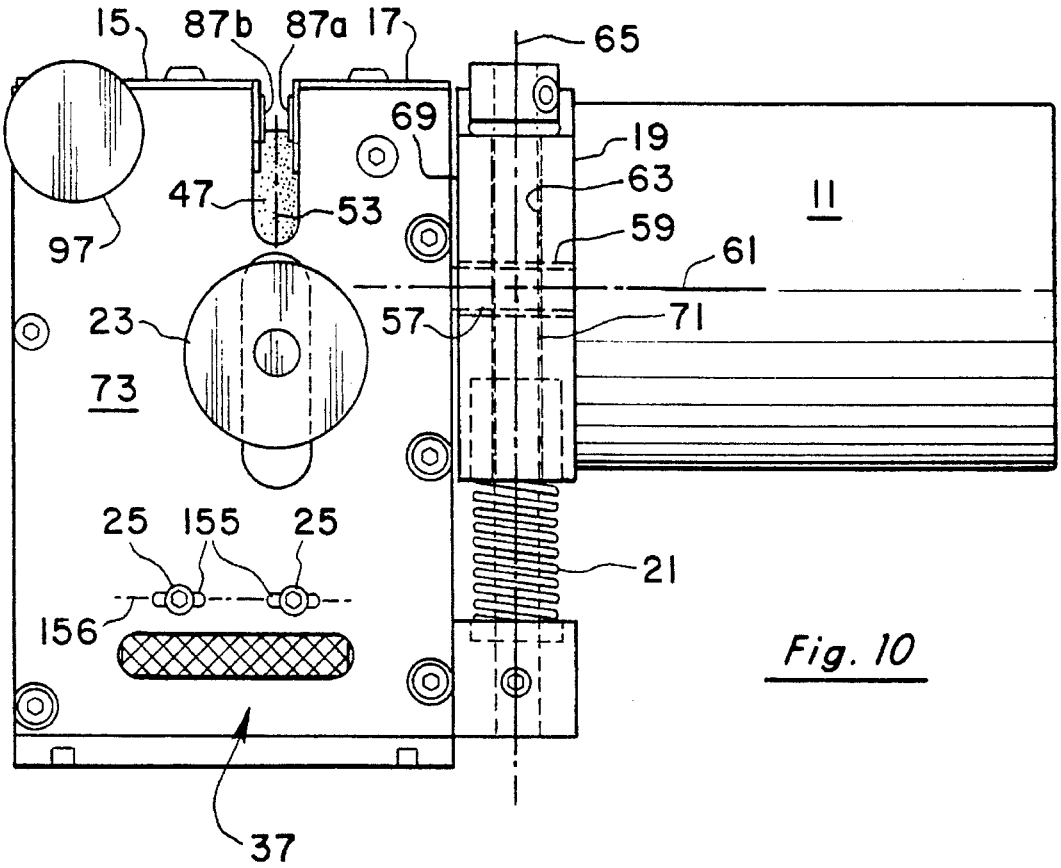
Fig. 10
Fig. 12
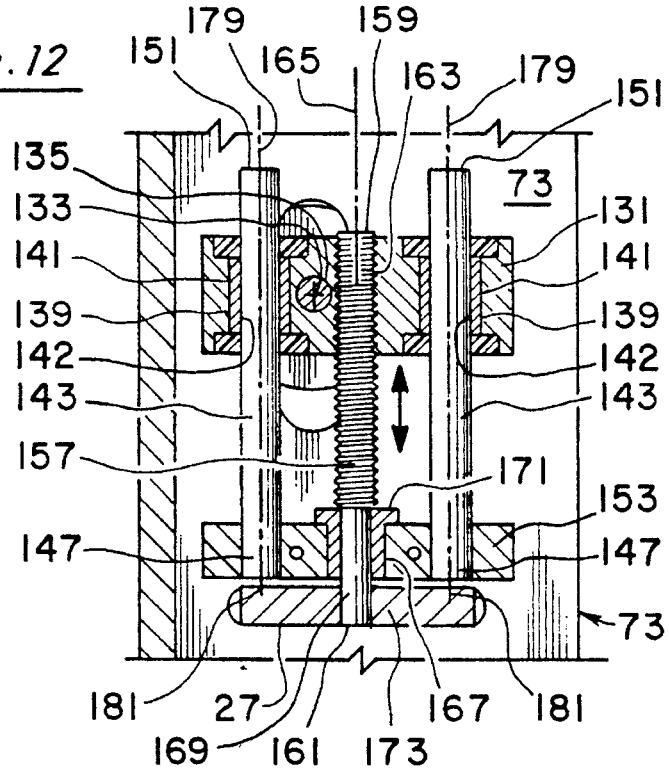

Fig. 13
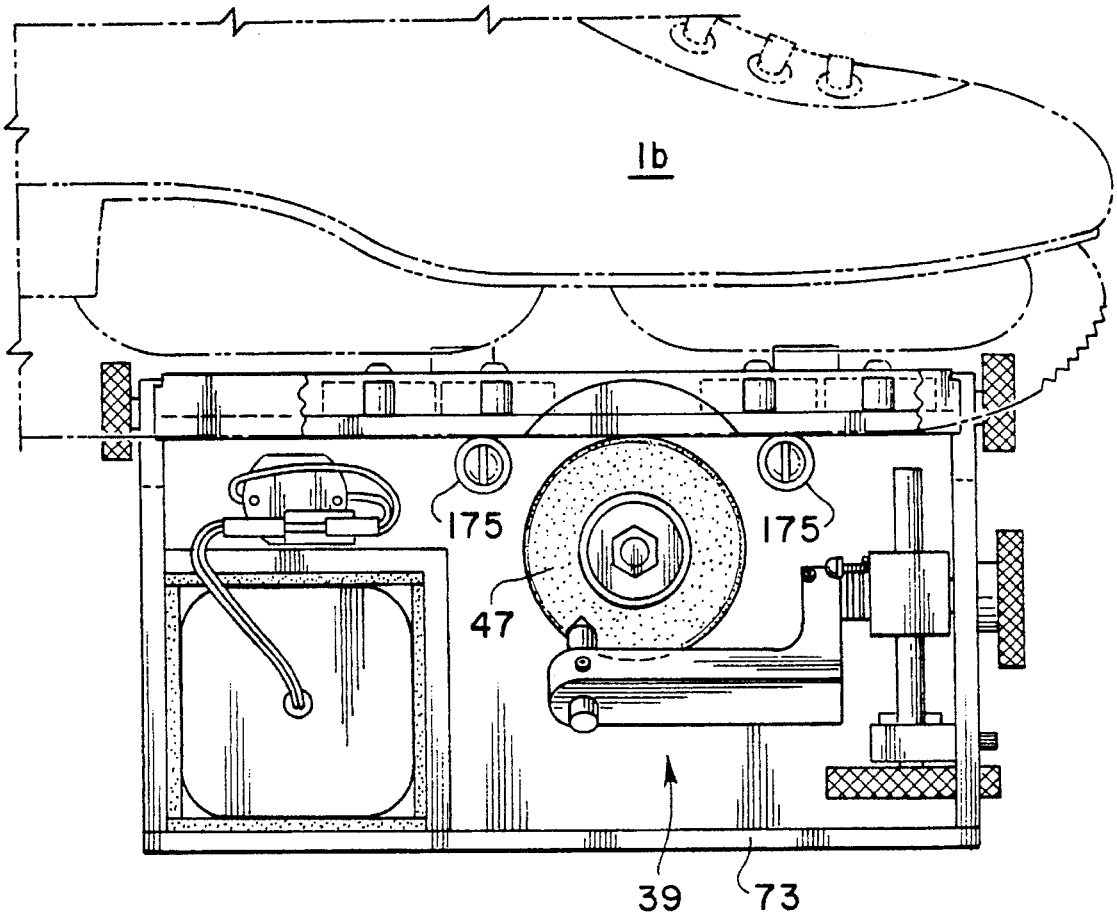
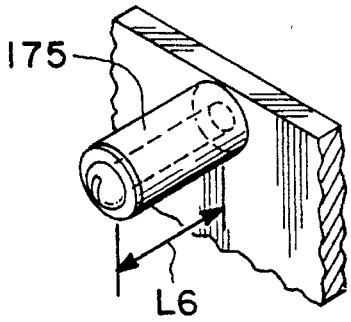
Fig. 13a
Fig. 14
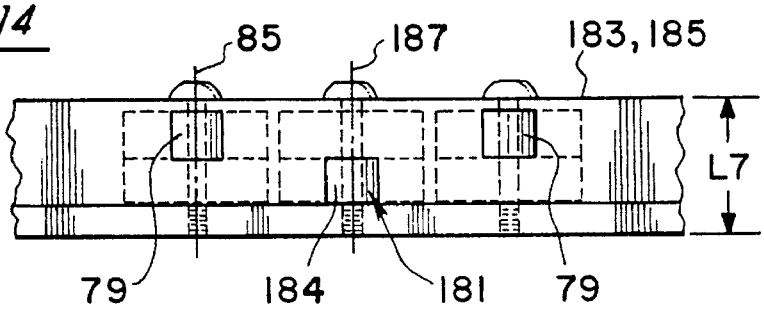

Fig. 15
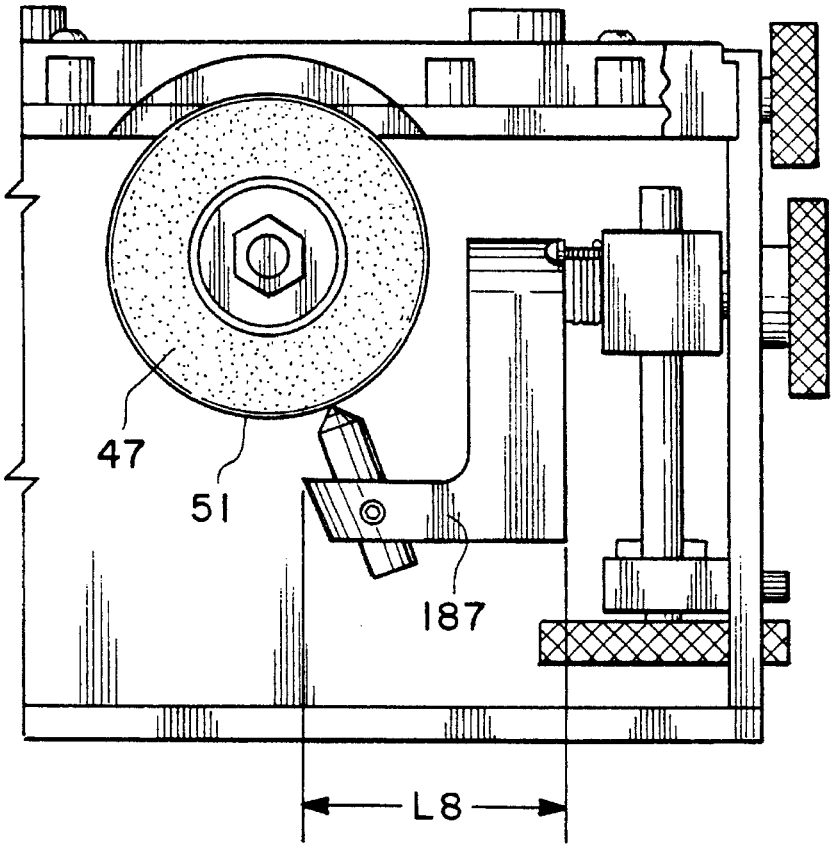
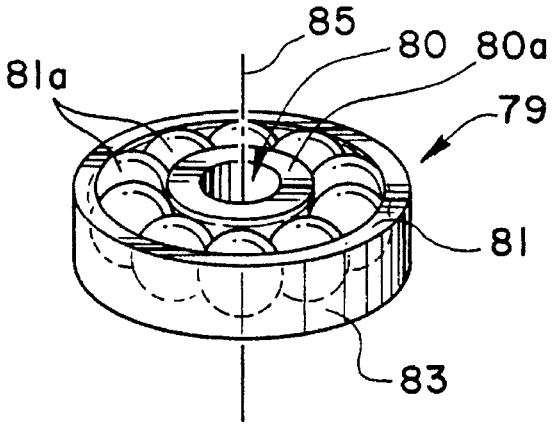
Fig. 16
(Prior Art)

Fig. 18
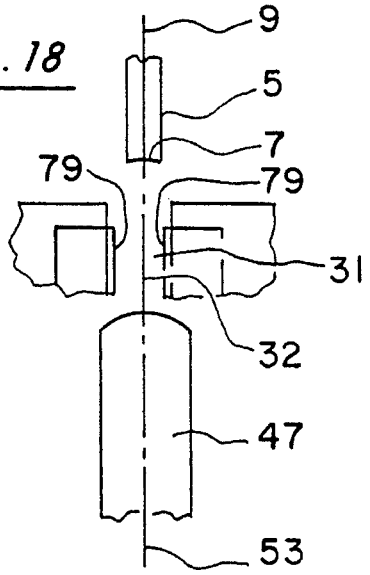
Fig. 19
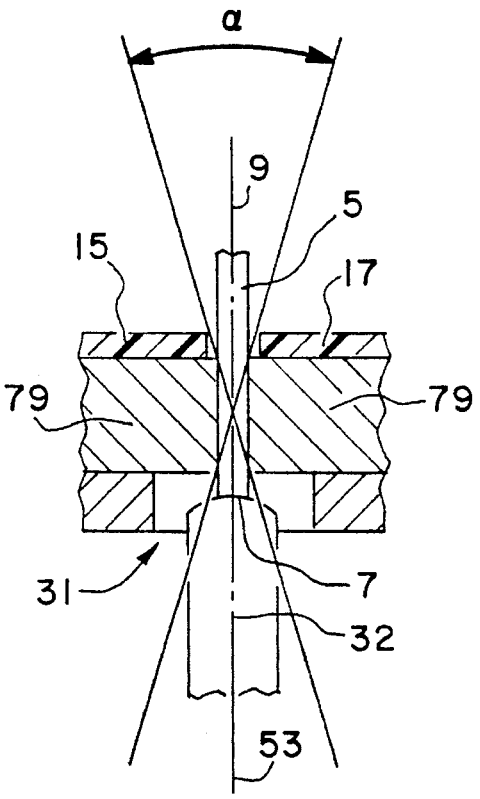
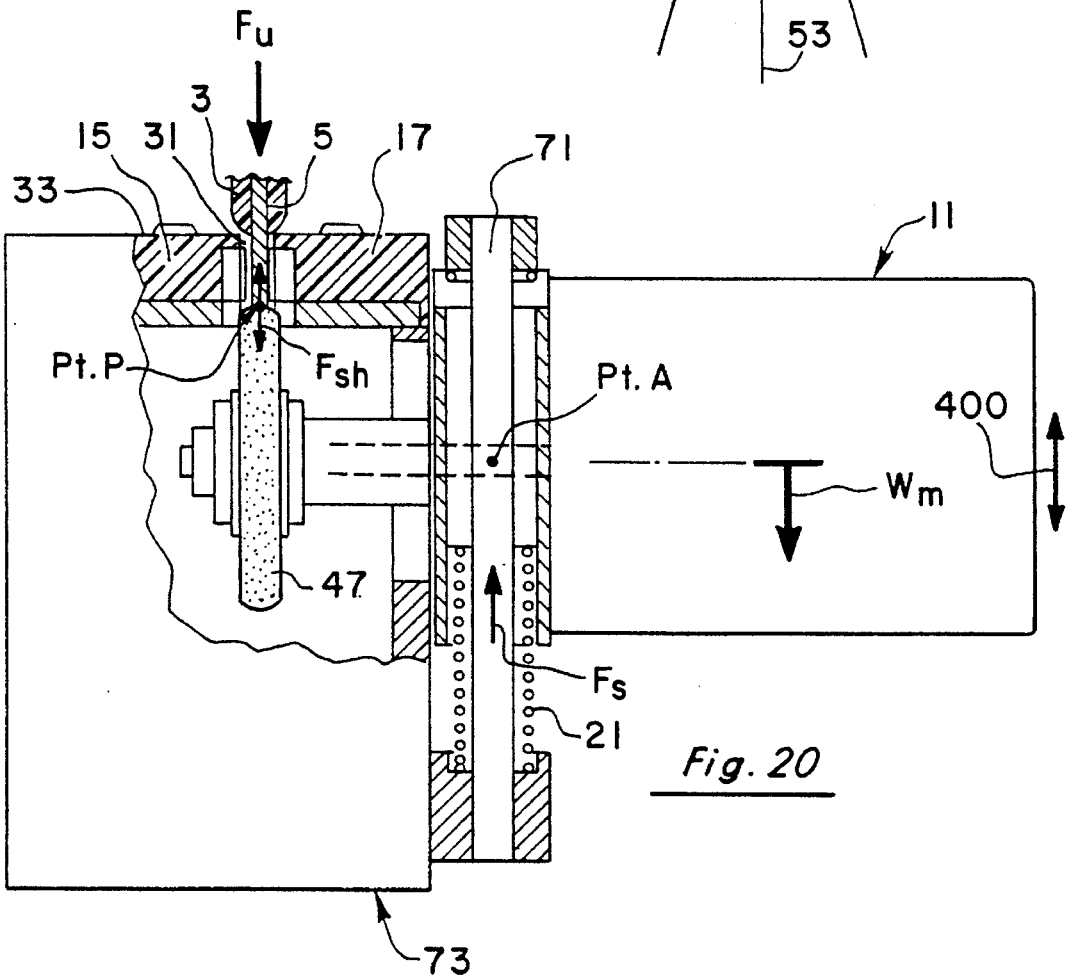
Fig. 20

PORTABLE BLADE SHARPENER FOR ICE SKATES

BACKGROUND OF THE INVENTION

1. Field of the Invention

This invention relates to the field of sharpening systems for ice skates, and more specifically, to the field of portable ice skate blade sharpeners.

2. Statement of the Problem

Virtually all modern ice skates, whether hockey, figure, speed, or other variety, utilize a metallic blade having a "hollow ground edge." Such an edge in contrast to a simple knife edge actually contacts the ice at two points separated by a hollow or recessed semicircular channel ground into the otherwise flat, narrow width of the blade. As with any metallic blade, the hollow ground edge becomes worn with use and loses its sharpness. This is particularly true when the ice skates are used at remote locations, such as ponds or lakes, where the edges of the ice skate blades are frequently deformed and dulled by impurities in the ice or by walking on surfaces other than ice. The edges can also be deformed through contact with other skates as commonly occurs, for example, in hockey games whether at such remote locations or in indoor rinks. Therefore, the edges must be periodically reshaped and/or sharpened to the original hollow ground profile to maintain the desired sharpness, and this frequently must be done at such remote locations or skating rinks. A need exists for a compact, portable sharpening device.

The prior art is replete with descriptions of systems for sharpening ice skate blades. For the most part, the prior art can be divided into two classes, manual devices and powered devices, and the powered devices can be subdivided into mounted and portable systems.

Manual devices typically contain an abrading stone, steel file, or other abrasive material. In use, such devices are typically held in contact with the edge and moved across the hollow ground edge with all cutting pressure and movement being manually supplied. At the elementary level, such devices would include a simple hand-held file with approximately the same radius as the inwardly curved surface of the hollow ground edge. More sophisticated manual designs include the use of guides. Regardless, such devices, while having the desirable trait of being portable, yield crude results as only the most experienced operator can maintain consistent cutting pressure. The average skater or person could not use such manual devices to sharpen blades. A clear need exists to provide a small, lightweight sharpener for use by a skater or other person that will reshape or sharpen a blade without extensive training or skill.

Powered devices, as discussed above, include both mounted and portable systems. Mounted or fixed systems might, for example, have large bench or floor-mounted components with rigid fixturing devices for holding the skate and guiding the blade in the proper orientation across a power-driven grinding member. Such large devices function very well in sharpening a blade, but are obviously not portable and usually are set up at a fixed location to which the skates have to be brought to be sharpened. These systems may weigh hundreds of pounds. Further, with such devices that include grinding wheels, it is critical to maintain proper alignment of the rotating wheel and the hollow ground edge since canting (i.e., side-to-side tilting) can dull one side of the edge while sharpening the other, and twisting of the blade about an axis perpendicular to its length can dull both sides of the edge. Some existing mounted systems have adequate fixturing to prevent canting and twisting. However, often even these devices depend on the operator to apply correct grinding pressure, hence requiring a degree of skill on the part of the operator to obtain consistent results. Furthermore, the guides found on such devices often require a degree of skill to even correctly adjust them. Finally, these sharpening systems are expensive to purchase and to maintain. A need exists even with such mounted systems for mechanisms to (1) ensure reshaping of hollow ground edges without canting and twisting, (2) maintain consistent grinding pressure, and (3) dress the grinding wheel to provide a true grinding surface.

Some devices utilizing powered rotating members have attempted to overcome the disadvantages of the mere hand-held manual tools and the expensive, heavy mounted systems while additionally offering a degree of portability. However, while many of these devices purport to be portable, they are not truly so, as they often require connection to a rotary drive such as an electric drill. Such devices, when connected to a drill, are bulky and awkward, making proper alignment with the blade difficult. Furthermore, as with many of the larger bench-mounted units, such devices often still rely on the skill of the operator to apply correct and consistent pressure to the grinding member in contact with the edge. In many cases, these supposedly portable devices lack any means to guide the rotating grinding members across the blade, and those that do often fail to effectively prevent canting and twisting of the blade. Even fewer of these devices have any means for maintaining the correct shape of the abrasive surface of the grinding element to sharpen the hollow edge of the blade. Hence, the need exists for an economical and truly portable powered sharpener. The need further exists for one that has an appropriate guide to prevent twisting and canting of the blade as it interacts with the abrasive surface and does not rely on the operator to apply consistent grinding pressure to the edge nor require any other special skills to operate in order to produce a consistent, sharpened hollow ground edge. The portable sharpener should also have a mechanism for periodically dressing the grinding surface of the grinding wheel.

3. Solution to the Problem

The present invention provides a novel solution to the aforementioned problems. With it, a blade sharpening system is provided that is inexpensive, light-weight, portable, self-powered and requires little operator skill yet yields results equal or superior to those of any of the larger and more expensive systems including those of the bench- or floor-mounted systems.

The portable blade sharpener of the present invention further provides a combined motor/grinder assembly that can be displaced within the housing of the sharpener when the blade of a skate is selectively inserted for sharpening. The weight of the motor assists in the displacement. The actual displacement of the grinding wheel against a bias mechanism provides a substantially constant grinding force directly into the hollow edge of the blade. The grinding force is independent from that supplied by the operator. The present invention ensures proper positioning of the grinding wheel to stay in the same plane as the plane of the blade. Hence, under the teachings of the present invention, the portable sharpener provides a desired grinding force directly aligned into the hollow edge of the blade as the blade is moved through the sharpener.

In another novel aspect of the present invention, a guide is provided on the upper surface of the sharpener. The guide has a formed slot, and the slot can be adjusted to different widths of blades. Hence, the user of the present invention selectively adjusts the slot to the width of the blade being sharpened. The adjustment of the slot width to the blade width is such that opposing bearing surfaces in the slot abut against the opposing side surfaces of the blade. Hence, as the blade is inserted through the slot, these bearing surfaces engage the sides of the blade. This enables the blade to easily move through the slot due to the action of the bearing surfaces, which prevent any cant or twist of the blade within the slot. Hence, as the user inserts the blade into the slot, the slot guides the blade in a true orientation over the grinding wheel, which is disposed between the bearing surfaces in the slot so that the user is assured that the hollow edge is aligned over the grinding surface of the grinding wheel over the entire length of the blade.

A novel dresser assembly is also provided in the portable sharpener of the present invention for periodically dressing the grinding surface of the grinding wheel. The dresser includes a grinding tip, a pivoting mechanism for moving the grinding tip in an arc of desired radius across the formed grinding surface of the wheel, a radius adjuster for changing the desired radius, and a location adjuster for changing the location of the grinding tip as the formed grinding surface of the wheel wears down, or if a new wheel of a different diameter is substituted. A particularly important feature of the dresser involves the radius adjuster, which allows the user of the portable sharpener of the present invention to actually adjust the radius of the hollow ground edge. For example, when the ice is very hard, a deeper hollow ground edge is required, and the dresser can be suitably adjusted.

Finally, all of the above features and mechanisms are packaged in a hand-held, lightweight, highly portable sharpener. The housing of the sharpener is designed so that each dimension is less than the length of the elongated blade being sharpened. A user of the sharpener of the present invention can quickly sharpen blades by holding the sharpener in his hand and sharpening the blade while wearing the ice skate. If a skate is damaged during use, no longer must a skater wait until he can return his skate to the location of a large, mounted sharpener; the user of the sharpener of the present invention can easily transport the sharpener to a remote location such as an ice rink or remote pool or lake to sharpen blades on location.

SUMMARY OF THE INVENTION

This invention involves a portable sharpening system for ice skate blades with hollow ground edges. The system in its preferred embodiment utilizes (1) a powered rotating grinding wheel, (2) an adjustable guide for preventing canting and twisting of the blade as it is sharpened, and (3) a dresser for periodically dressing the grinding wheel.

The grinding wheel extends on either side of a central plane perpendicular to its rotational axis and is mounted to an electric motor attached to a sliding block on the housing biased toward a first position by springs. With the system of the present invention, a substantially constant grinding pressure is applied to the edge irrespective of the force applied to the skate by the operator. The displacement of the grinding wheel is generally limited to the depth of the blade. The grinding wheel is upwardly biased against the edge of the blade by biasing springs. In this manner the cutting pressure between the blade and grinding wheel is substantially constant throughout the sharpening process since the force supplied by the biasing springs depends on displacement, and the displacement caused by the depth of the blade remains substantially constant over the length of the blade.

A guide assembly is provided wherein the guide slot can be infinitely adjusted using a cam mechanism to the precise width of the blade. A plurality of bearing surfaces is provided on opposing sides of the blade to prevent canting and twisting of the blade during sharpening and to allow the blade to easily pass through the slot without difficulty.

The portable sharpening system further includes a dressing mechanism to maintain the proper curvature of the grinding wheel. This dressing assembly includes a diamond-tipped stylus mounted to a dressing arm that rotates in a circular arc with a radius matching the desired curvature of the grinding wheel. The dressing arm and stylus are fully adjustable for alignment with the central plane of the grinding wheel, as well as for applying different curvatures to the grinding wheel if desired. The stylus is rotated across the surface of the grinding wheel as the wheel rotates to reshape the grinding surface to the desired curvature. When the system is in use to sharpen the ice skate blade, the stylus and dressing arm are positioned so as not to interfere with the displacement of the wheel.

In use, a blade of a hockey or other skate having a hollow ground edge can be easily and quickly sharpened. In doing so, the bearing surfaces of the system are first adjusted so that a sliding fit exists between the blade and the bearing surfaces. The blade is then passed between the surfaces (which align the blade with the central plane of the grinding wheel and prevent canting and twisting of the blade) with the edge in contact with the grinding surface. The blade interacts with the grinding wheel and tends to displace the grinding wheel as it moves between the bearing surfaces and across the grinding surface.

The blade sharpening system of the present invention further includes a battery power source, making the system truly portable. The entire system is also compact, having a length less than the length of the blade. This allows a skate to be sharpened at remote locations, whether on a skater's foot or not, and yields a sharpened hollow ground edge equal or superior to that produced by much larger and more costly bench- or floor-mounted systems.

DESCRIPTION OF THE DRAWING

FIG. 1 is an illustration of a prior art hockey skate;

FIG. 2 is a cross-sectional view of the prior art blade of the hockey skate taken along line 2 of FIG. 1;

FIG. 2*a* illustrates a variation of the hollow ground edge shown in FIG. 2;

FIG. 3 is an illustration of a prior art ice skate used by a goalie in ice hockey;

FIG. 4 is an illustration of a prior art figure skate;

FIG. 9*b* shows the grinding wheel in a first position and shows the movement of the stylus in a circular arc; FIG. 9*a* shows the grinding wheel in a second position interacting with the skate;

FIG. 10 shows the second end of the blade sharpening system;

FIG. 11*a* illustrates the tip-end of the stylus;

FIG. 12 is a cross-sectional view taken along line 12 of FIG. 8;

FIG. 13 is a side view of an additional embodiment of the blade sharpening system with the side removed;

FIG. 13*a* is an illustration of the cylindrical member of the additional embodiment of FIG. 13;

FIG. 14 illustrates an additional embodiment of the bearing surfaces;

FIG. 15 shows an alternate embodiment of the dressing arm;

FIG. 16 is an illustration of a prior art cylindrical bearing of the preferred embodiment;

FIG. 18 illustrates the central planes of the blade, the insertion slot, and the grinding wheel;

FIG. 19 illustrates the guide assembly of the present invention aligning the hollow edge of the blade with the curved grinding surface in a true sharpening relationship without canting;

FIG. 20 illustrates the force relationships among the motor, the bias springs and the blade to achieve a desired substantially consistent grinding pressure;

DETAILED DESCRIPTION

1. Overview

Figure 5:
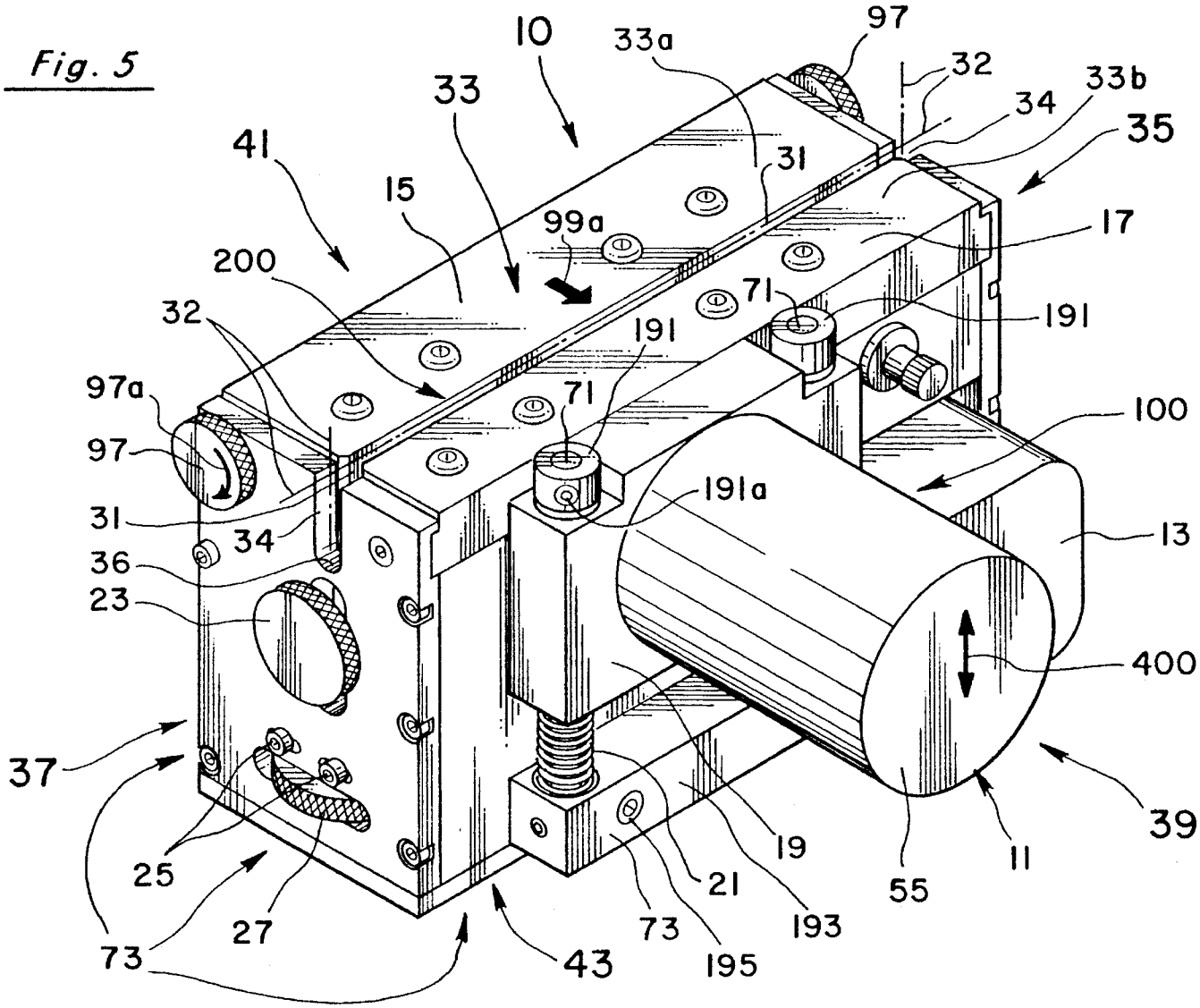
FIG. 5 is a perspective view of the blade sharpening system of the present invention.

Modern ice skates, whether a hockey skate 1 (FIG. 1 ), a goalie skate 1*a* (FIG. 3), or a figure skate 1*b* (FIG. 4), have an elongated blade 5, 5*a*, 5*b*. The hockey skate 1 has a blade support member 3 extending the entire length of the blade 5. The goalie skate 1*a* has only a partial blade support member 3*a* extending over only a portion of the blade 5*a*. The figure skate 1*b* lacks any blade support member.

A hollow ground edge 7 is illustrated in FIG. 2, which is a cross-section of the blade 5 of the hockey skate 1. The blade 5 has a narrow width W extending outwardly on each side of a central plane 9 with a hollow ground edge 7. The widths W can vary in dimension. The blades 5, 5*a*, 5*b* each have a hollow ground edge 7 with a radius R. FIG. 2*a* illustrates a blade 5 having a smaller radius R', hereinafter termed a "deep" hollow ground edge 7.

The portable blade sharpening system 10 of the present invention is illustrated in FIG. 5. The blade sharpening system 10 is designed to be used primarily to sharpen the edge 7 of the blade 5 of the hockey skate 1, although it could also be used to sharpen the blade 5*a* of the goalie skate 1*a* as well as the blade 5*b* of the figure skate 1*b*, or any other blade having a hollow ground edge 7 as will be discussed below.

Figure 8:
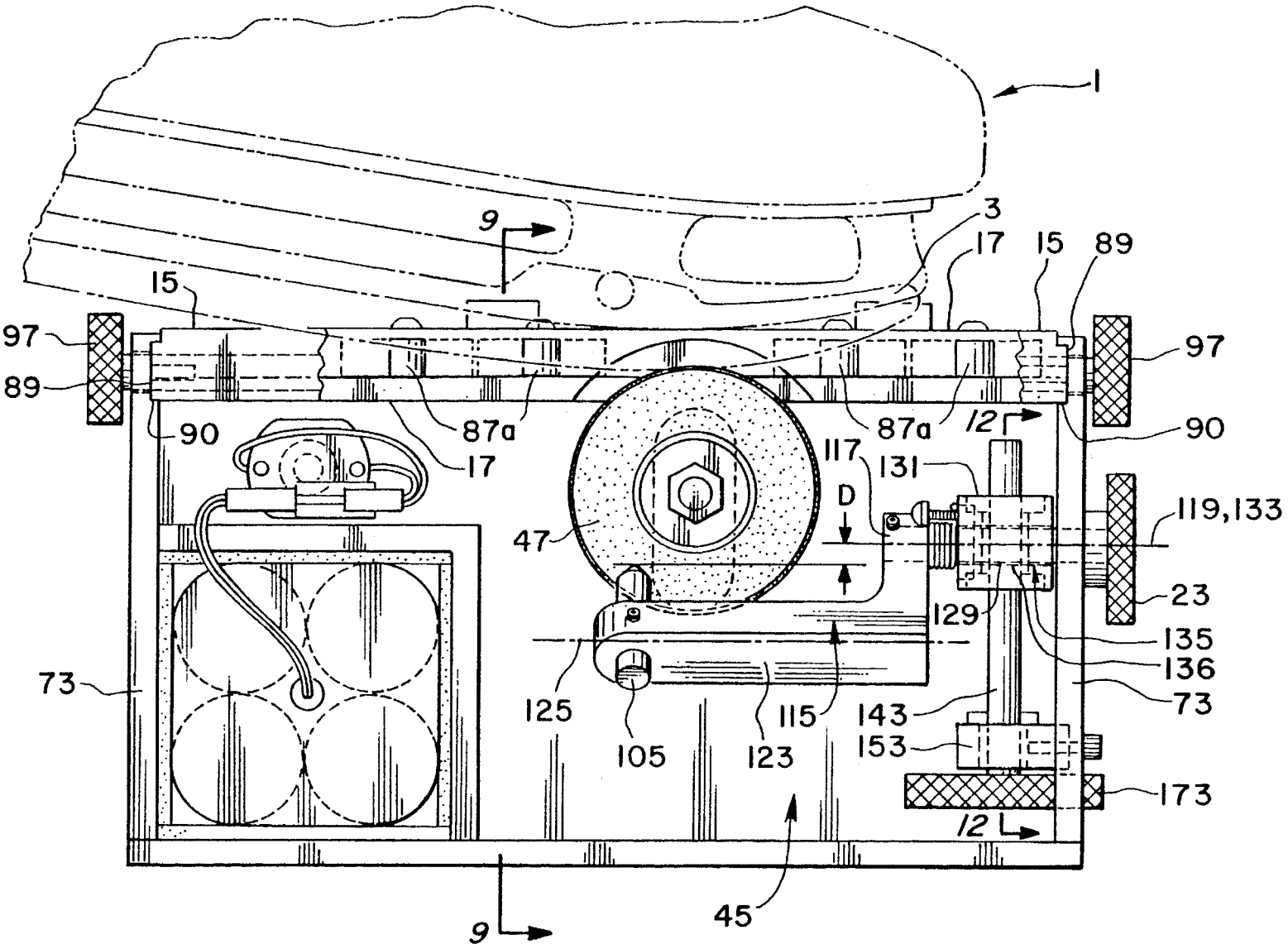
FIG. 8 is a side view of the blade sharpening system shown in FIG. 5 with the side removed and shows the interaction of the hockey skate with the system.

The blade sharpening system 10 as shown in FIG. 5 is a small portable device with an attached electric motor 11 powered by a battery power source 13. The blade sharpening system 10 has a substantially planar top 33, a first end 35, a second opposing end 37, a first side 39, a second opposing side 41, and a planar bottom 43, all connected to thereby define an interior volume 45 (as shown in FIG. 8). An affixing member 193 is mounted to side 39. The top 33, bottom 43, sides 39, 41, ends 35, 37, and affixing member 193 collectively form a base or housing 73. It is to be expressly understood that the base 73 could be formed as a unitary structure, or be constructed of several individual members as described herein.

The top 33 has a slot 31 centered on a central plane 32. The first 35 and second 37 ends also have slots 34 centered on the central plane 32. As will be discussed, the blade 5 is inserted into slots 31 and 34 for sharpening.

The blade sharpening system 10 features a bias assembly 100 for applying a constant grinding pressure to the edge 7 of the blade 5, a guide assembly 200 incorporated into top 33 having guide members 15 and 17 for guiding the blade 5 in slot 31 without canting or twisting, and a dressing assembly 300 (shown in FIG. 11 ) for periodically dressing the grinding wheel. These and other features are discussed at length as follows.

The blade sharpener 10 shown in FIG. 5 is a preferred embodiment and it is to be expressly understood that a variety of design changes, orientations of components and base configurations could be made without departing from the spirit and scope of the present invention.

The blade sharpener 10 of the present invention is lightweight such as in a range of three to ten pounds, and each dimension of the housing is on the order of the length of a typical adult-sized blade being sharpened. This results in a hand-held, highly portable sharpener that can be easily used by a skater even when wearing the skates.

2. Bias Assembly 100

FIG. 5 shows the external portions of the bias assembly 100 to include the electric motor 11, the motor support block 19, a pair of rods 71, a pair of springs 21 and a pair of stops 191. The motor 11 and the motor support block 19 are designed to travel in the direction of arrows 400 with respect to the base 73 during sharpening of a blade 5. When a blade 5 is not being sharpened, the springs 21 bias the motor 11 to an upper rest position.

Figure 11:
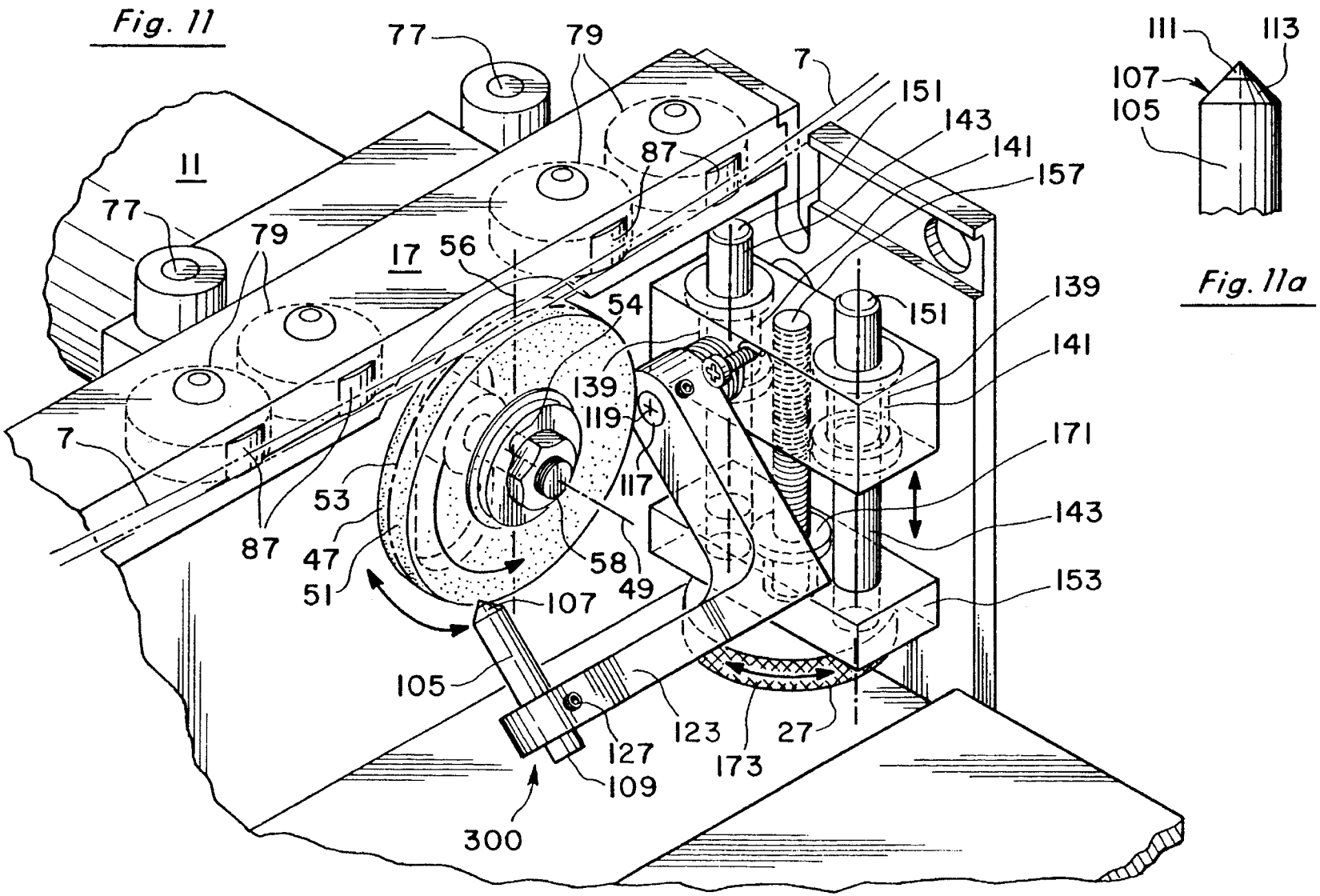
FIG. 11 is a perspective view of the interior of the blade sharpening system shown in FIG. 5 showing the grinding wheel and dressing assembly.

As shown in FIG. 11, the electric motor 11 is connected to a grinding wheel 47 having a rotational axis 49 and a grinding surface 51 extending outwardly on each side of a central plane 53. The central plane 53 is perpendicular to the rotational axis 49. The grinding wheel also has a center 54 at the intersection of the rotational axis 49 and the central plane 53. As shown in FIG. 11, the grinding wheel also has a second axis 56 lying in the central plane 53 and passing through the center 54. The grinding surface 51 (shown in FIG. 7*b*) has an outward curvature of radius R2.

Figures 9A, 9B:
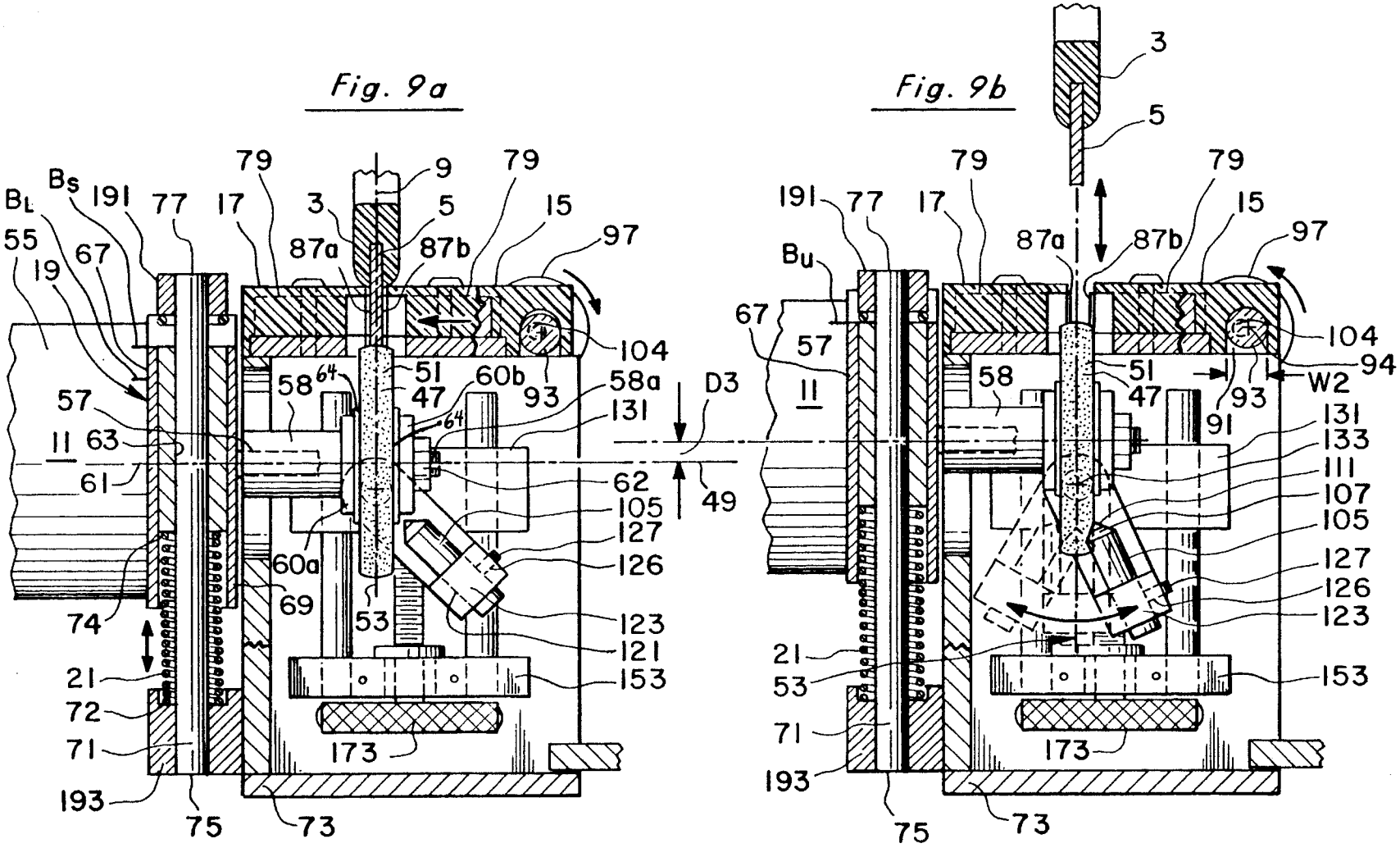
FIGS. 9*a* and 9*b* show a cross-sectional view taken along line 9 of FIG. 8.

As shown in FIG. 9*a*, electric motor 11 is preferably of a direct current type and has a housing 55 (also shown in FIG. 5) and a drive shaft 57. The bias assembly 100 further has a motor support block 19 (also shown in FIG. 5) with a back side 67 and a front side 69. As shown in FIG. 10, the motor support block 19 has a first formed cylindrical hole 59 with an axis 61 and second and third formed cylindrical holes 63, with axes 65. The axes of holes 63 are substantially perpendicular to the axis 61 of the first hole 59. The first hole 59 has a diameter slightly larger than the diameter of the drive shaft 57.

As illustrated in FIG. 9*a*, the housing 55 of the electric motor 11 is mounted to the back side 67 of the motor support block 19 by well-known means (e.g., mating screw threads, pressed fit, or by soldering, brazing, welding or gluing).

As shown in FIG. 10, the drive shaft 57 projects from the front side 69, and is substantially aligned with and substantially parallel to the axis 61 of the first hole 59 of the motor support block 19. Referring to FIG. 9*a*, a spindle 58 is mounted to the drive shaft 57, and the grinding wheel 47 is mounted to the spindle 58 with the rotational axis 49 being substantially aligned with and substantially parallel to the axis 61 of the first hole 59 of the block 19. The grinding wheel 47 can be mounted to the spindle 58 using a number of conventional means. In this preferred embodiment, a portion 58*a* of the spindle 58 has external threads, and the grinding wheel 47 is placed on the spindle 58 between two blotters 64 and two flanges 60*a* and 60*b*, and a nut 62 is tightened against the outside flange 60*b*.

As shown in FIGS. 5, 9*a*, and 10, the bias assembly 100 further includes two substantially identical cylindrical rods 71 each having a first end 75 and a second end 77, and two substantially identical compression springs 21 having internal diameters larger than the diameters of the rods 71 and having first 72 and second 74 ends. The rods 71 pass through the internal diameters of the springs 21 and through the second and third holes 63 of the block 19. The first ends 75 of the rods 71 are attached to the affixing member 193 of the base 73. The affixing member, as shown in FIG. 5, is attached to the first side 39 of the base 73 using conventional means (e.g., conventional screws 195, as shown in FIG. 5). The first ends 72 of the springs 21 abut the affixing member 193 of the base 73, and the second ends 74 abut the block 19. The springs 21 are of sufficient length so that assembling the springs 21 between the block 19 and the affixing member 193 requires compressing the springs 21 thereby applying a biasing force to the block 19.

As shown in FIG. 9*b*, stops 191 mounted toward the second ends 77 of the rods 71 determine a biased position, $B_U$, of the block along the rods 71. The stops 191 can be raised or lowered along the rods 71 to adjust the biased upward position $B_U$ of the grinding wheel 47 with respect to the slot 31 (see FIG. 9*b* and FIG. 5). The stops 191 are raised or lowered by loosening set screws 191*a* (see FIG. 5), moving the stops to a new biased upper position $B_U$, and then tightening the set screws 191*a*. For additional ease of adjusting stops 191, conventional wing nuts or knobs could be fixably attached to the ends of the set screws 191*a* to facilitate manual turning without using a wrench or other tool. The motor 11 and grinding wheel 47 occupy a sharpening biased position, $B_S$, as shown in FIG. 9*a*, when the blade 5 abuts against the wheel 47. The grinding wheel 47 can move lower than position $B_S$ along the rods 71 to the position $B_L$.

The second and third holes 63 have diameters slightly larger than the diameter of the rods 71 so as to form a sliding fit (e.g., 0.001" to 0.003" clearance). Due to the close clearances between the second and third holes 63 and the block 19, the direction of sliding movement of the block 19 along the rods 71 is limited to being substantially in a plane parallel to the central plane 53 of the grinding wheel 47. Movement of the block 19 along the rods 71 toward the affixing member 193 of the base 73 compresses the springs 21. The second and third holes 63 could be larger than described above, but other means such as cylindrical bushings, bearings, or oil-impregnated cylindrical bushings inserted into said holes 63 would be needed to restrict the movement of the block 19 along the rods 71 to a plane substantially parallel to the central plane 53 of the grinding wheel 47. Such bushings with an internal diameter only slightly larger than the diameter of the rods 71 would be pressed into such larger cylindrical holes 63. Obviously, many different types of conventional bearings and bushings could be similarly used.

Although compression springs 21 are described above, other types of springs could obviously be used. For instance, one or more metallic leaf springs or pneumatic springs could be utilized in conjunction with the above described rods 71 and block 19 arrangement, or with other means for limiting the movement of the grinding wheel 47 to substantially the central plane 53.

Although the primary purpose of the springs 21 is to apply a substantially consistent grinding pressure to the edge 7, the bias assembly 100 as described above also serves the additional purpose of limiting the torque that is applied by the electric motor 11 to the grinding wheel 47. Electric power consumption of the electric motor 11 is approximately proportional to the torque applied, so the useful life of the battery power source 13 is extended by use of this and similar mounting assemblies of the present invention.

The bias assembly 100 of the present invention operates as follows. As shown in FIG. 9*b*, the pair of springs 21 apply a force to move the motor 11 and grinding wheel 47 to the upper bias position, $B_U$, in the rest state (i.e., no blade 5 is being sharpened). As shown in FIG. 9*a*, when the blade is inserted in slot 31, the blade abuts against the wheel 47 to move the motor 11 and grinding wheel 47 to a sharpening position, $B_S$, in the sharpening state. The lowest position for travel is indicated at $B_L$. The motor 11 and the wheel 47 move in unison with respect to the housing 73. Typical total travel between $B_U$ and $B_L$, is the range of one-half to one inch.

In FIG. 20, the movement of the motor 11 in the direction of 400 is illustrated. The motor 11 is connected to the grinding wheel 47 through the housing 73. When a blade 5 is inserted into the slot 31 by the user of the present invention, the motor 11 and the grinding wheel 47 move to the sharpening bias position, $B_S$. This is the position illustrated in FIG. 20. In proper use, the user inserts the blade 5 into slot 31 and exerts a force $F_U$ to the blade 5 at least equal to the force supplied by the spring $F_S$ so as to displace the grinding wheel 47 to the sharpening position $B_S$ with the blade support member 3 supported by the top surface 33. The top surfaces 33*a*, 33*b* apply a reactionary force equal to and opposite $F_U$ through the blade support member 3, thereby supporting the skate 1 through the blade support member 3. Hence, the sharpening force $F_{Sh}$ between the grinding wheel and the edge 7 of the blade 5 at Point P is independent of the force $F_U$, but instead is determined by the spring force $F_S$ supplied by the springs 21. The separation and independence of the sharpening or grinding force $F_{Sh}$ from the force $F_U$ applied by the user is highly desirable because, as stated above, consistent grinding pressure at Point P is advantageous to obtaining a true, sharpened edge.

By mounting the housing 55 of the motor 11 to the back side 67 of the block 19 opposite from the grinding wheel 47, the weight of the motor $W_M$ counteracts the torque about Point A caused by the sharpening force $F_{Sh}$ supplied to the grinding wheel 47 by the edge 7 of the blade 5 at Point P. Hence, this preferred orientation of the motor 11 with respect to the grinding wheel 47 reduces or eliminates the torque to the block 19, thereby facilitating the sliding of the block 19 along rods 71 by reducing friction therebetween.

It is to be expressly understood that, under the bias mechanism 100 of the present invention, the user of the present invention simply inserts the blade 5 into the sharpener 10 to a point where the blade support 3 abuts against the surface 33 and pushes the blade 5 through the slot. When doing so, a substantially constant grinding pressure exists throughout the length of the blade at Point P produced by the substantially constant sharpening force $F_{sh}$, which is determined by the spring force $F_S$.

It is to be expressly understood that the apparatus described above could be modified into equivalent structures. For example, the springs 21 and rods 71 could be placed on the side wall of the housing 73, or on the inside surface of the housing 73. Likewise, the motor 11 can be connected to the block 19 in a number of different approaches. This particular bias assembly 100 could also find application in non-portable or mounted powered skate sharpening systems.

It is important to recognize that what has been presented is a bias assembly that permits the user to pass a blade across the grinding wheel 47 for sharpening without concentrating on the force of application $F_U$ (shown in FIG. 20). This is especially true with respect to the hockey ice skate of FIG. 1 wherein the support 3 extends substantially the length of the skate blade 5. However, in the skate 1*a* of FIG. 3, the support 3*a* extends for most of the blade 5 and, in that situation, the user would have to pay attention to the force $F_U$ when the portion of the blade 5*a* over which the guide member 3*a* is not present is being sharpened. In the case of an ice skate 1*b* shown in FIG. 4, no support 3 is provided.

The preferred embodiment discussed above relies on the blade support member 3 to prevent the continued movement of the blade 5 in the slot 31 between bearing surfaces 87 in the direction of the displacement of the grinding wheel 47. Obviously, the figure skate 1*b* and goalie skate 1*a* do not have a continuous blade support member. To accommodate these types of skates, an additional embodiment is shown in FIG. 13. As shown in FIG. 13, two cylindrical members 175 are mounted to the first side 39 of the base 73 on each side of the grinding wheel 47 just below the guide members 15, 17. As shown in FIG. 13*a*, the cylindrical members 175 should have sufficient length L6 to project from the first side 39 beyond the slot 31 so as to support the blade 5 when inserted in the slot 31 as shown in FIG. 13. FIG. 13 shows the interaction of the figure skate with the cylindrical members 175 and the grinding wheel 47. As shown, the cylindrical members 175 limit the insertion of the blade in the direction of the displacement of the grinding wheel to a distance less than the distance between the first position (shown in FIG. 9*b*) and the second position (shown in FIG. 9*a*) of the grinding wheel 47. Obviously, many other similar means could be used. Certainly a cylindrical shape is not required, nor are separate elements. For instance, the bottom portions 36 (shown in FIG. 5) of slots 34 of the base 73 would also limit the movement of the blade 5 in the direction of the displacement of the grinding wheel 47 toward the base 43.

3. Guide Assembly 200

As shown in FIG. 5, the blade sharpening system 10 includes a guide assembly 200 to guide the blade 5 through slot 31 centering the central plane 9 of the blade 5 with the central plane 32 of the slot 31. As shown in FIG. 18, the goal is to align the central plane 9 of the blade 5 with the central plane 32 of the slot 31 formed partially by guide members 15, 17 to ensure that the plane 9 aligns with the central plane 53 of the grinding wheel 47.

Figure 6:
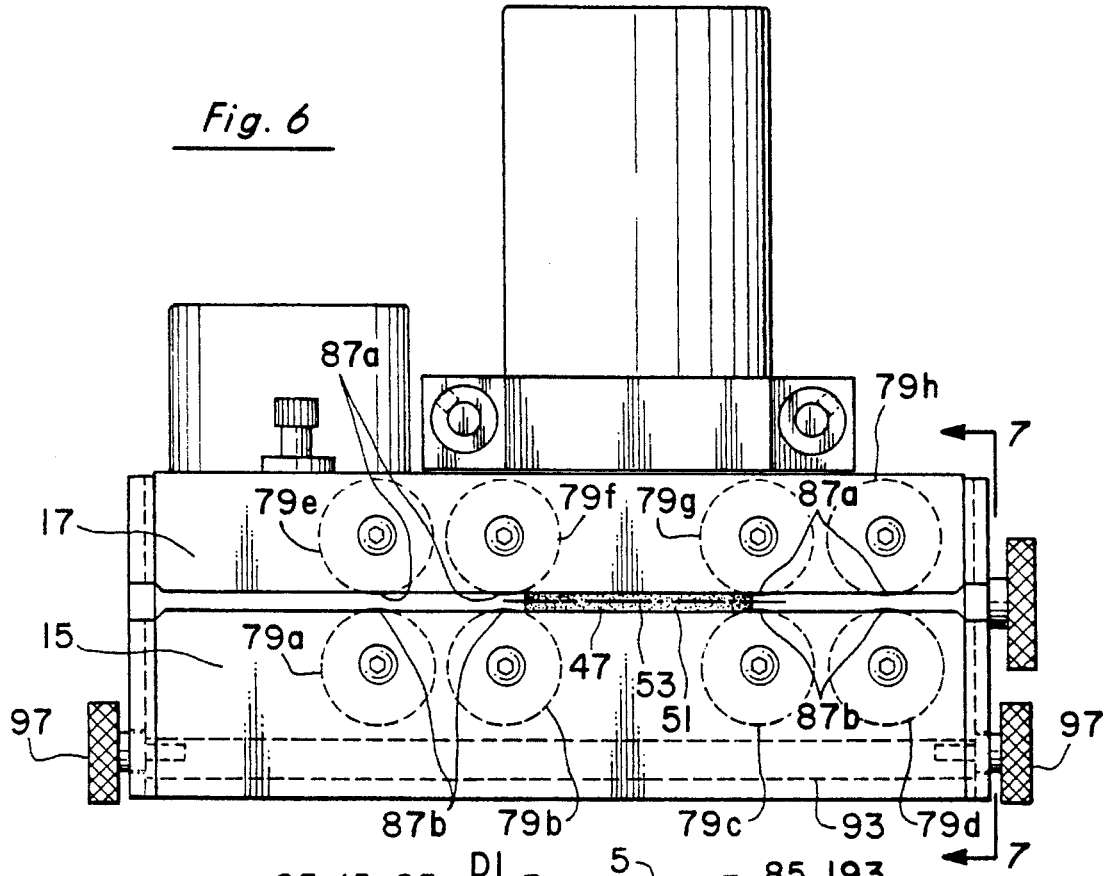
FIG. 6 is a top view of the blade sharpening system shown in FIG. 5.
Figure 7A:
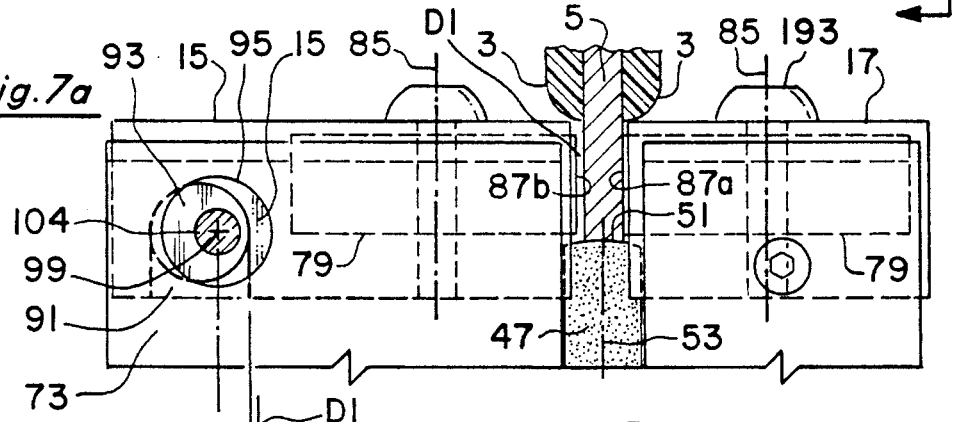
FIG. 7 shows two cross-sectional views taken along line 7 of FIG. 6, the two views, FIGS. 7*a* and 7*b*, demonstrating the operation of the cam actuator used to adjust the distance between the bearing surfaces.
Figure 7B:
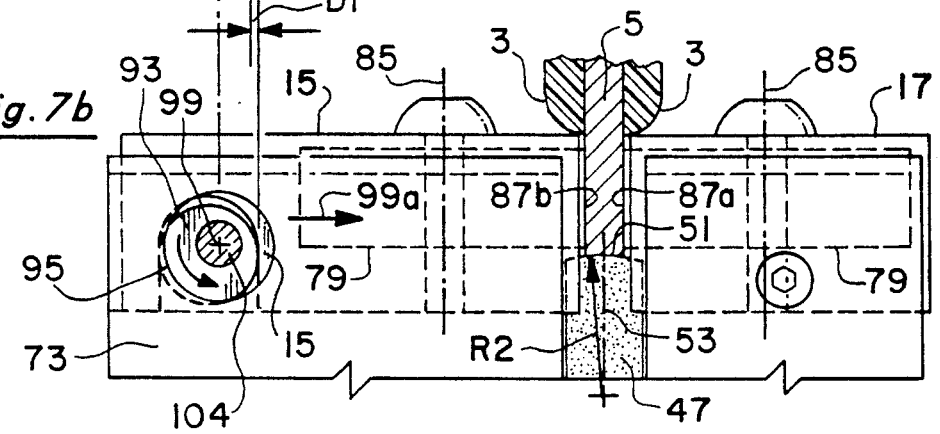

The guide assembly 200 includes a first guide member 15 and a second guide member 17 as shown in FIG. 5. As shown in FIG. 6, each guide member 15, 17 has four conventional cylindrical roller bearings (79*a–d*, 79*e–h*, collectively referred to herein as 79). Each roller bearing 79 (shown in FIG. 16) has a formed center hole 80 in an inner race 80*a*, an axis of rotation 85 and an outer race 81 with an exterior surface 83. Ball bearings 81*a* are placed between the outer race 81 and the inner race 80*a*. It is to be expressly understood that many designs for roller bearings exist. Some, for example, may have a lesser or greater number of ball bearings, or eliminate ball bearings 81*a* altogether. FIG. 16 represents only one of many varieties of bearings that could be used. The roller bearings 79 are mounted to the respective guide members 15, 17 by conventional mounting means (e.g., as shown in FIG. 7*a*, a shoulder screw 193 with a shoulder of slightly smaller diameter than the center hole 80 of the bearing 79) so that the axes of rotation 85 for all the roller bearings 79 are substantially aligned in parallel, as shown in FIGS. 7*a* and 7*b*. The exterior surfaces 83 of the four roller bearings 79*e–h* collectively form a first bearing surface 87*a* (as shown in FIGS. 6, 7*a*, 7*b*, 8 and 10) of the guide member 17. Likewise, the exterior surfaces 83 of the four roller bearings 79*a–d* form a second bearing surface 87*b* (shown in FIG. 10) of the guide member 15. The bearing surfaces 87*a,b* oppose each other in the slot 31 and are substantially perpendicular to the top 33 (see FIG. 5) formed by the planar top surfaces 33*a* and 33*b* of the first and second guide members 15, 17, respectively.

The guide member 17 is fixably mounted to the base 73 with the bearing surface 87*a* parallel to the central plane 53 of the grinding wheel 47 and spaced a distance therefrom (as shown in FIGS. 7*a* and 7*b*), said distance being approximately half of the width W of the blade 5 (shown in FIG. 2). The guide members 15, 17 are mounted to the base 73 so that the central plane 53 of the grinding wheel 47 lies between the bearing surfaces 87 in an upwardly biased first position, $B_U$, shown in FIG. 9*b*. When the blade 5 is downwardly passed between the bearing surfaces 87, it contacts the grinding surface 51 (as illustrated in FIG. 9*a*). The bearing surfaces 87 are adjusted (as shown in FIG. 9*a* and as described below) to slidably fit with the sides of the blade 5. The term "slidably fit" or "sliding fit" means that the surfaces 87 contact the sides of blade 5 or are in close proximity thereof. The term "sliding fit" includes what might be termed in the art as a "running fit." The term "slidably fit" or "sliding fit" as used herein, whether in the context of cylindrical or other members, means that the members move and/or turn easily and/or run freely with respect to each other. As shown in FIG. 11, two bearings 79 of each bearing surface 87 lie on each side of the second axis 56 of the grinding wheel 47.

Figure 8A:
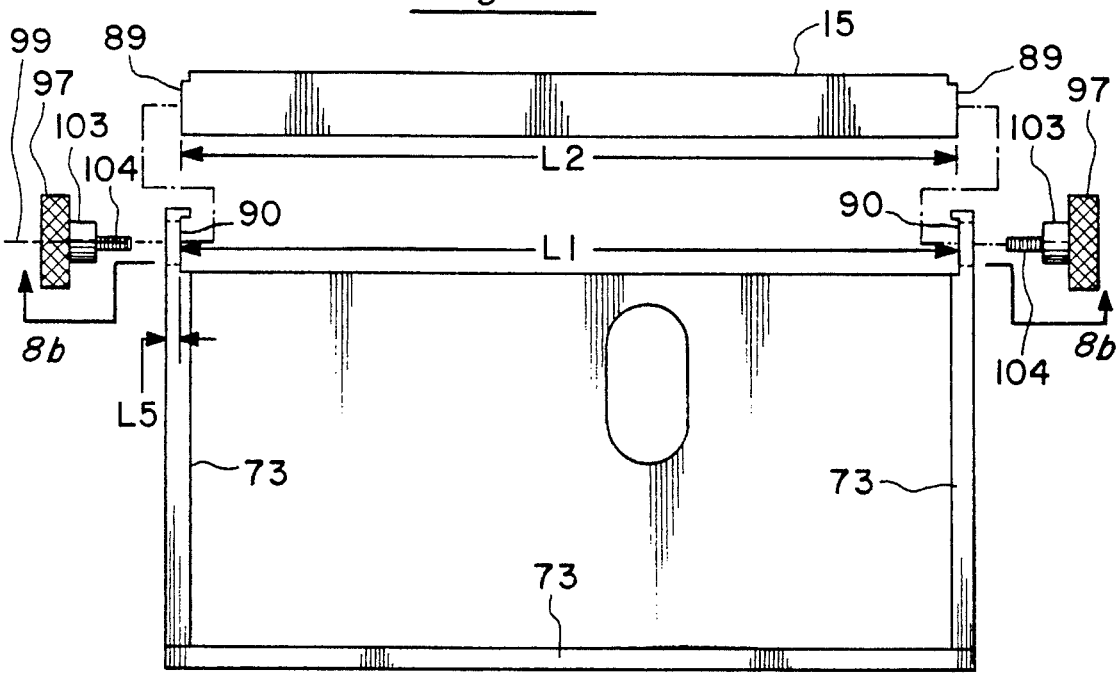
FIG. 8*a* is a side view of the system showing only the assembly of the movable guide member and cam actuator.
Figure 8B:
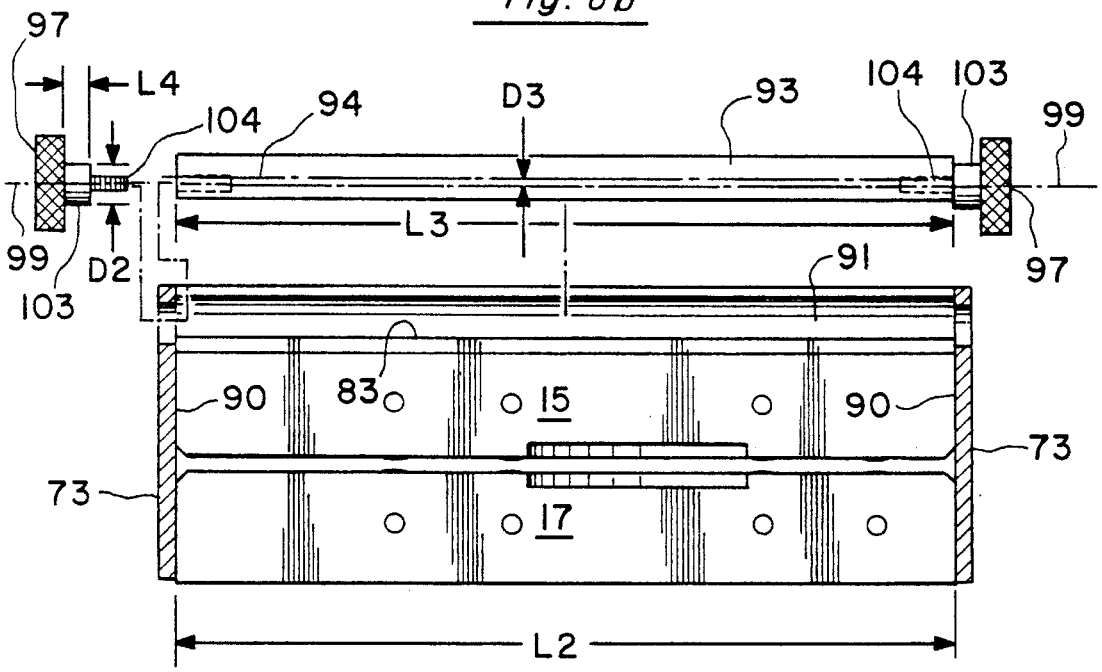
FIG. 8*b* is a cross-sectional view taken along line 8*b* of FIG. 8*a;*

As shown in FIG. 8*a*, the guide member 15 has extended portions 89 on each side that slidably engage mating slots 90 of the base 73. The guide member 15 also has a slot 91 of width W2 as shown in FIG. 9*b*. As shown in FIG. 8*b*, the blade sharpening system 10 also has a cylindrical cam 93 having a diameter slightly less than the width W2 of the slot 91 of guide member 15. The length L3 of the cam 93 is slightly longer than the length L2 (shown in FIG. 8*a*) of the guide member 15, but slightly less than the length L1 shown in FIG. 8*a*. The cam 93 has a central axis 94 (see FIG. 8*b*). As shown in FIG. 7*a*, the base 73 has substantially identical cylindrical holes 95 on each of the first 35 and second 37 ends.

As shown in FIG. 8, the blade sharpening system 10 also has two substantially identical knobs 97. The knobs 97 have a length L4 (see FIG. 8*b*) at least greater than the length L5 shown in FIG. 8*a*, and a portion 103 with a diameter D2 (as shown in FIG. 8*b*) slightly smaller than the diameter of the holes 95. As shown in FIG. 8*b*, the knobs 97 each have an axis 99 and are mounted (e.g., conventional screw threads 104) to the cam 93 with their respective axes 99 substantially aligned, said axes 99 being substantially parallel to the axis 94 of the cam 93 and spaced a distance D3 therefrom. The cam 93 is mounted to the base 73 by inserting the knobs 97 through the holes 95 to engage the cam 93. In the preferred embodiment, the knobs 97 engage the cam 93 and are mounted thereto by conventional mating screw threads 104.

In operation, the knobs 97 rotate about the axes 99 within the cylindrical holes 95. The cam 93 is contained within the slot 91 of the guide member 15, and the guide member 15 is retained by the slots 90 of the base 73. Referring to FIGS. 7*a* and 7*b*, the bearing surface 87*b* of the guide member 15 is moved toward the bearing surface 87*a* of the guide member 17, as shown by arrow 99*a*, by rotating the knobs 97, thereby rotating the cam 93. The surface of the cam 93 contacts the inner surface of the slot 91, thereby urging the guide member 15 towards the bearing surface 87*a*. The slots 90 constrain the guide member 15 to substantially only sliding motion. Hence, due to the friction between the surface of the cam 93 and the slot 91, the friction between guide member 15 and the slots 90, the constraint provided by the slots 90, and other factors, the position of the bearing surface 87*b* of the guide member 15 is substantially fixed except when the cam 93 is rotated by the knobs 97. By this arrangement, the distance between the bearing surfaces 87 is infinitely adjustable over the range of movement as determined by the width W2 of the slot 91, the diameter of the cam 93, and the distance D3 between the axes 99 of the knobs 97 and the axis 94 of the cam 93.

While the preferred embodiment includes the cam arrangement described above, it is to be understood that the guide assembly 200 of the present invention includes all means for adjusting the distance between the bearing surfaces. For example, a screw-type mechanism such as that used to move the dressing means described below (see e.g., FIG. 12, the threaded rod 157, mounting member 173, and holder 131) could be adapted to selectively move an appropriately modified embodiment of guide member 15.

Figure 17:
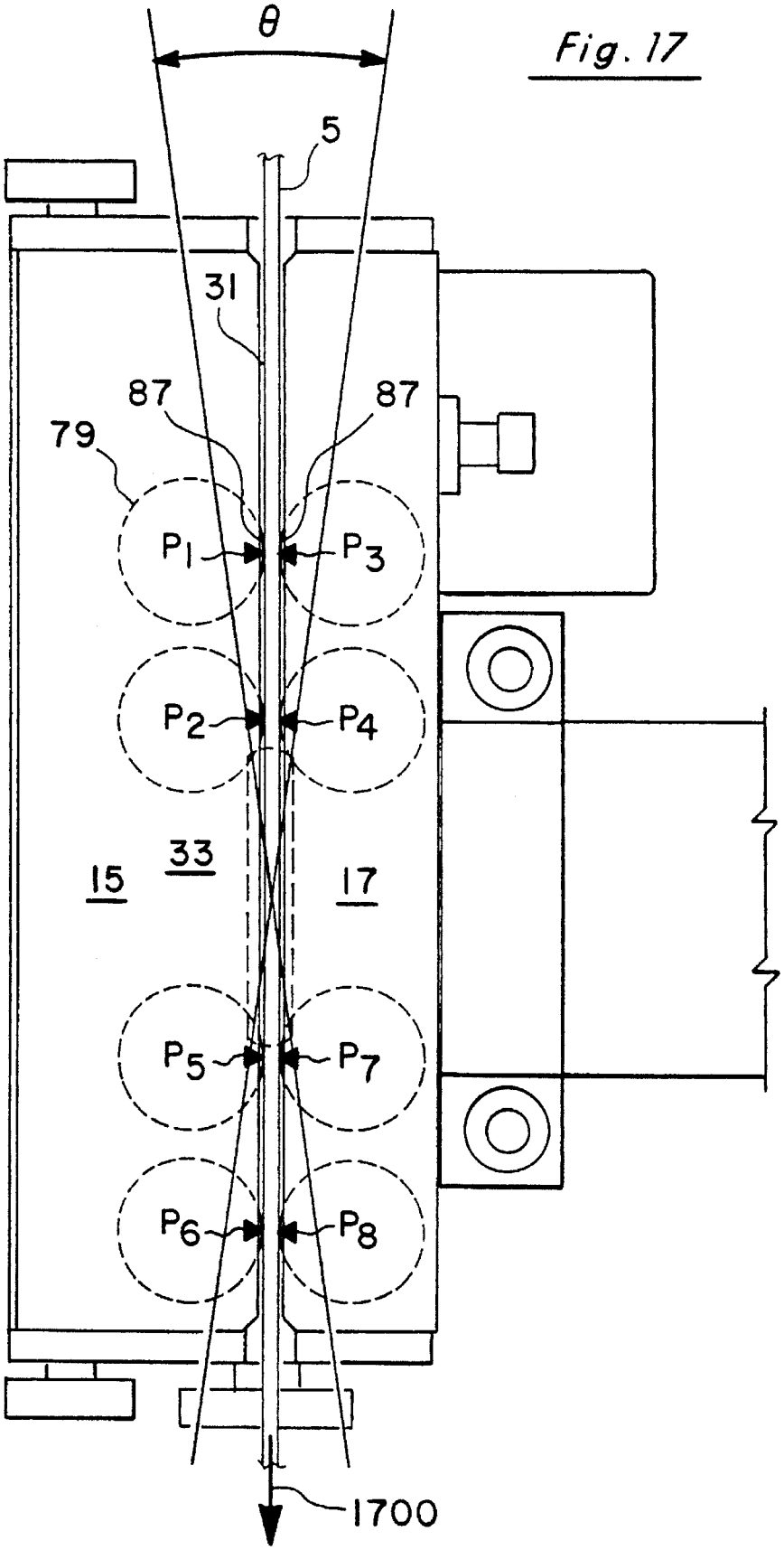
FIG. 17 illustrates the guide assembly of the present invention preventing twisting of the blade during sharpening.

In summary, the operation of the guide assembly 200 is as follows. In FIG. 5, the user of the sharpener 10 of the present invention turns knobs 97 as shown by arrow 97*a* to move the entire guide member 15 uniformly towards non-movable guide member 17 so as to infinitely adjust the width of the slot 31 to the actual width of a blade 5. This enables the user to provide a sliding fit with the bearing surfaces 87 (as shown in FIG. 7*b*) against the blade 5. Different skates 1 have blades 5 with different widths W. As shown in FIG. 17, the bearings 79 have their surfaces 83 slidably fit with the sides of blade 5. This provides bearing points of contact $P_1$, $P_2$, $P_3$, $P_4$ on one side of grinding wheel 47 and points of contact $P_5$, $P_6$, $P_7$, $P_8$ on the other side of grinding wheel 47. These points of contact prevent any movement of the blade 5 in the Θ direction (twist) as the blade 5 is moved in the direction 1700 through slot 31. The roller bearings 79 at each of these points $P_1$–$P_8$, however, permit the blade 5 to easily move in the slot 31 without binding. As illustrated in FIG. 18, the bearings 79 by slidably fitting against the sides of blade 5 align the planes 9, 32, and 53, thereby ensuring the alignment of the grinding wheel 47 directly into the hollow ground edge 7 of the blade 5 for sharpening. Hence, the present invention achieves careful alignment of the blade 5 without movement in the Θ direction to the grinding wheel 47 in a compact sharpener. The guide assembly 200 also prevents cant, α, of the blade 5 as shown in FIG. 19. Also, as the blade 5 is moved in the direction 1700 through the slot 31, the guide assembly, through contact at the points P of contact described above, also straightens the blade 5 if it has become slightly bent during use.

While a preferred embodiment of the guide assembly 200 has been shown for use in a portable sharpener, it is to be expressly understood that this mechanism could also be adapted for use in non-portable or mounted skate sharpeners. The goal of this assembly 200 is to prevent canting and twisting of the blade 5 as it moves through the slot 31 and is sharpened. This ensures the correct hollow ground profile for the edge 7 of the blade 5. The sharpened blade 5 is true without twist or cant. It is also to be expressly understood that, while a preferred structural approach has been set forth equivalent structures could also be used.

4. Dressing Assembly 300

As shown in FIG. 2, the hollow ground edge 7 of the blade 5 has an inwardly curved surface, the curvature of which has a radius R. To sharpen the edge 7 using the grinding wheel 47 with its axis of rotation 49 perpendicular to the central plane 9 of the blade 5, it is important that the grinding surface 51 (as shown in FIG. 7*b*) have an outwardly curved grinding surface. The outward curvature of the grinding surface should have a radius R2 (shown in FIG. 7*b*) (which is unrelated to the diameter of the grinding wheel 47) corresponding to the desired inward curvature R.

Through use, the grinding surface 51 can become deformed from the desired radius R2 due to wear. Furthermore, skaters often desire to change the curvature R of the edge 7 as ice conditions vary. For instance, a "deep grind" (shown in FIG. 2*a*), meaning a curvature with a small radius (shown in FIG. 2*a* as R'), is desirable for "hard ice" conditions. A "shallow grind," meaning a curvature with a larger radius (shown in FIG. 2 as R), is desirable for "soft" ice conditions. Therefore, the blade sharpening system 10 has a dressing assembly 300 to shape the outwardly curved surface 51 to the desired radius of curvature R2.

As best seen in FIG. 11, the dressing assembly 300 utilizes a stylus 105 having a tip-end 107 and a second end 109. In this preferred embodiment, as shown in FIG. 11*a*, the stylus 105 has a single industrial-grade diamond 111 set in a cylindrical metallic holder 113. Such arrangements are commercially available. Obviously, any material having a hardness greater than that of the material of the grinding surface 51 could be used (e.g., carbide, hardened steel, or other hard mineral or stone).

As illustrated in FIG. 8, the dressing assembly 300 includes a dressing arm 115 having a first portion 117 with an axis 119, and a second portion 123 with an axis 125. The axes 119, 125 of the first and second portions 117, 123 are substantially parallel and offset from each other. As shown in FIG. 11, the stylus 105 is mounted to the second portion 123 with the tip-end 107 projecting outward from the second portion 123 toward the axis 119 of the first portion 117 with a distance D (see FIG. 8) them between.

As shown in FIG. 9*a*, the second portion 123 has a cylindrical hole 121, and the stylus 105 passes through the hole 121. The second portion 123 also has a second cylindrical hole 126 with internal screw threads. A set screw 127 (shown in FIG. 9*a*) mates with threads in the cylindrical hole 126 of the second portion 123 and forcibly contacts the stylus 105, thereby fixing the minimum distance D between the tip-end 107 of the stylus 105 and the axis 119 of the first portion 117. The distance D can be adjusted by loosening the set screw 127, moving the stylus 105 within the hole 121 to a second position, and then tightening the set screw 127. This distance D determines the radius R2 of the outwardly curved grinding surface 51 of the grinding wheel 47. The distance D between the tip-end 107 and the axis 119 of the first portion 117 should be substantially the same as the radius R of desired curvature of the hollow ground edge 7.

The first portion 117 has a bearing surface 129 (as shown in FIG. 8). The dressing assembly 300 also has a holder 131 to rotatably support the first portion 117 at the bearing surface 129. The holder 131 has a first cylindrical hole 135 having an axis 133 and an inner bearing surface 136. The first portion 117 of the dressing arm 115 passes through the first hole 135 with the first portion 117 supported at the bearing surface 129 by the inner bearing surface 136 of the first hole 135. The diameter of the hole 135 is slightly larger than the first portion 117 at the bearing surface 129 so as to allow a rotating fit with the axis 119 of the first portion being substantially aligned and parallel to the axis 133 of the first hole 135. Obviously, the hole 135 could be enlarged to allow one or more conventional bearings or bushings to be inserted with the interior surfaces of the bearings or bushings supporting the first portion 117 of the dressing arm 115 at the bearing surface 129. Regardless, the clearance between the bearing surface 129 and the inner bearing surface 136, whether formed by the hole 135 or the interior surface of a bearing or bushing, should be close so as to keep the axis 119 substantially aligned and substantially parallel to the axis 133. A third knob 23 is mounted to the first portion 117 of the dressing arm 123 to facilitate the manual rotation of the dressing arm 123.

As shown in FIG. 12, the holder 131 also has portions defining two substantially identical cylindrical holes 139 extending about axes 179 substantially parallel to each other and substantially perpendicular to the first axis 133 of the first hole 135 of the holder 131. The holder 131 further includes an interior surface defining an additional cylindrical hole 163 extending about an axis 165 substantially parallel to the axes 179 of holes 139. The interior surface of the hole 163 has internal screw threads. As shown in FIG. 12, the holder 131 has cylindrical bushings 141 having interior cylindrical holes 142 pressed into the holes 139.

The dressing assembly 300 further includes two cylindrical rods 143 having diameters slightly smaller than the diameter of the two cylindrical holes 139. The rods 143 have first ends 147 (shown in FIG. 12 ), second ends 151, and axes 181. The holder 131 is slidably mounted to the base 73 by passing the second ends 151 of the rods 143 through the cylindrical holes 142 of the bushings 141. The holes 142 of the bushings 141 are sized so that a sliding fit (e.g., approximately 0.002" clearance ) exists between the rods 143 and the bushings 141. This close sliding fit restricts the holder 131 to sliding movement along the rods 143 in a direction substantially parallel to the axes 179 of the holes 139.

Referring again to FIG. 12, the first ends 147 of the rods 143 are mounted to the mounting member 153, which is mounted to the base 73 so that the axis 133 of the first hole 135 of the holder 131 substantially lies in the central plane 53 of the grinding wheel 47 (as shown in FIG. 9*b*), and so that the movement of the holder 131 along the rods 143 moves the tip-end 107 with respect to the grinding surface 51 of the grinding wheel 47. As shown in FIG. 10, the second end 37 of the base 73 has two slots 155 extending outwardly from axes 156 each aligned with the other and both substantially perpendicular to the central plane 53 of the grinding wheel 47. Conventional screws 25 pass through the slots 155 to attach the mounting member 153 to the second end 37 of the base 73. By loosening the screws 25, the first axis 133 of the first hole 135 of the holder 131 can be moved into the central plane 53 of the grinding wheel 47 by moving the screws 25 within the slots 155, thereby placing the first axis 119 of the first portion 117 of the dressing arm 115 in the central plane 53.

As illustrated in FIGS. 11 and 9*b*, by rotating the first portion 117 of dressing arm 115 about the first axis 119, the tip-end 107 of the stylus 105 is rotated in a circular arc about the grinding surface 51 of the grinding wheel 47, with the center of the circular arc lying substantially along the axis 133 of the first hole 135 of the holder 131, which is aligned using said screws 25 to lie in the central plane 53 of the grinding wheel 47. The circular arc lies in a plane substantially perpendicular to the central plane 53 of the grinding wheel 47, as shown in FIG. 9*b*.

To fix the position of the holder 131 along the rods 143, as well as to selectively cause movement of the holder 131 along the rods 143, a threaded rod 157 is used as shown in FIGS. 11 and 12. This movement of the holder 131 is desirable to bring the tip-end 107 of the stylus 105 into contact with the grinding surface 51 after the surface has been worn through use, or when for example, a worn-out grinding wheel is replaced by a new wheel having a larger diameter.

As shown in FIG. 12, the threaded rod 157 has external threads extending along a portion from a first end 159 toward a second end 161, and a non-engaging portion 169 extending from the second end 161 toward the first end 159. In this preferred embodiment, the non-engaging portion 169 is not threaded, but has a diameter smaller than the outside diameter of the external screw threads. The mounting member 153 has a cylindrical hole 167 with a diameter larger than the non-engaging portion 169 of the threaded rod 157. The external threads of rod 157 frictionally mate with the threaded hole 163 of the holder 131, and the non-engaging portion 169 extends through hole 167 of the mounting member 153. A washer 171 with a center hole having a diameter larger than the non-engaging portion 169 but smaller than the maximum diameter of the external threads of the threaded portion is assembled between the mounting member and the threaded portion as shown in FIG. 12 with the threaded rod 157 passing through the center of the washer 171. A fourth knob 173 is fixed to the second end 161 of the threaded rod 157 as shown in FIG. 12.

Hence, in use, the manual turning of the fourth knob 173 exerts a force on the holder 131 through the mating threads to cause the holder 131 to move along the rods 143 substantially parallel to the axes 179 of the holes 139. The washer 171 and fourth knob 173 oppose the tendency of the rod to move axially due to the reactionary forces exerted by the holder 131 to the threaded rod 157 through the mating threads. The friction between the mating threads and between the threaded rod 157 and the washer 171 assists in fixing the position of the holder 131 along the rods 143.

5. Use of the Preferred Embodiment

To sharpen the edge 7 of the blade 5 of a hockey skate 1, the narrow width W of the blade 5 is first inserted between the bearing surfaces 87 as shown in FIG. 8 (the skate 1 being represented by phantom lines). The blade 5 is inserted until the blade support member 3 rests on the top surfaces 33 of the guide members 15, 17 (as shown in FIGS. 8 and 9*a*). Once the blade 5 has been inserted, the cam 93 is turned (as illustrated in FIG. 7*b*) using the knobs 97 to cause the guide member 15 to move towards guide member 17. The position of the cam 93 is adjusted until there exists a sliding fit between the bearing surfaces 87 and the blade 5. The fit should be adjusted to allow the blade to rotatably engage the races 81 of the bearings 79 so as to be easily moved lengthwise through the slot 31 formed by the bearing surfaces 87. With the proper adjustment, the bearings 79 prevent both canting and twisting of the blade and restrict the blade 5 to sliding movement. As shown in FIG. 9*a*, when the guide member 15 is adjusted as described above, the central plane 9 of the blade 5 is substantially co-planar with the central plane 53 of the grinding wheel 47.

In inserting the blade, the blade will contact the grinding surface 51 of the grinding wheel 47 and cause the grinding wheel 47 to be displaced from its upwardly biased first position (shown in FIG. 9*b* as $B_U$) to a second position (shown in FIG. 9*a* as $B_S$), this displacement being in a direction substantially normal to the surface 51 of the grinding wheel 47.

As previously mentioned, it is desirable that the pressure between the edge 7 and the tool used to sharpen the edge not depend on the operator as results would vary depending on the skill of the operator. The blade sharpening system 10 accomplishes this goal by using springs 21 to apply a force to the grinding wheel 47 biasing the grinding wheel toward the first position $B_U$ (shown in FIG. 9*b*) and away from the second position $B_S$ (shown in FIG. 9*a*) while the top surfaces 33 of the first 15 and second 17 guide members support the blade support member 3 (as shown in FIGS. 8 and 9*a*), thereby limiting the movement of the blade 5 to a position between the first $B_U$ and second $B_S$ positions of the grinding surface 51 of the grinding wheel 47.

After the guide member 15 is adjusted, the edge 7 is sharpened by inserting the blade 5 so that the blade support member 3 rests on the top surfaces 33. The blade 5 is then moved from one end to the other across the grinding surface 51. More than one pass may be required to obtain the desired degree of sharpness.

To periodically dress the outwardly curved grinding surface 51 of the grinding wheel 47, the grinding wheel 47 is allowed to return to the first biased position (shown in FIG. 9*b* as $B_U$). The first axis 119 of the dressing arm 115 is aligned with the central plane 9 of the grinding wheel 47 using the screws 25. The first axis 119 of the of the dressing arm 115 is moved in a plane substantially co-planar with the central plane 53 of the grinding wheel 47 by turning the knob 173 to move the diamond 111 of the tip-end 107 of the stylus 105 to contact the grinding surface 51. Then, without a blade between the guide surfaces 87 and with the grinding wheel 47 rotating, the dressing arm 115 is rotated about its first axis 119 using the knob 173 (shown in FIG. 8) thereby moving the tip-end 107 in a circular arc lying (shown in FIG. 9*b*) in a plane substantially perpendicular to the central plane 53 of the grinding wheel 47. The diamond 111 of the tip-end 107, being harder than the material of the grinding surface 51, removes material from the grinding wheel 47 to thereby form the desire outwardly curved grinding surface 51 with radius R2.

6. Additional Embodiments

An improvement to the guide means described above is illustrated in FIG. 14, which shows a portion of improved guide members 183, 185. To further prevent canting of the blade 5, at least an additional cylindrical roller bearing 181 is added to each guide member 15 and 17 to form improved guide members 183, 185. The improved guide members 183, 185 are substantially identical to the guide members 15, 17 described above, except that the dimension L7 shown in FIG. 14 is larger than that of guide members 15, 17 so as to accommodate the additional superposed roller bearing 181. The additional roller bearing 181 is substantially identical to the roller bearings 79 shown in FIG. 16. Each of the first and second bearing surfaces (similar to bearing surfaces 87) is formed by the roller bearings 79 and the exterior surface 184 of the additional roller bearing 181. The roller bearings 79 of each guide member 183, 185 have a superposed relationship to the additional roller bearing 181, which is similarly mounted to the guide members 183, 185 with its axis of rotation 187 substantially aligned and parallel to the axes 85 of the roller bearings 79.

However, it is to be understood that the present invention is not to be limited to these two embodiments of the guide assembly 200 described herein. For instance, the cylindrical roller bearings could be eliminated altogether, and the bearing surfaces could be formed by two opposing planar surfaces with no bearings. In such a configuration, "Teflon" or other material with a low friction coefficient could be used to facilitate the sliding of the blade between the surfaces. Also, cylindrical nonrotating inserts made of a low friction material could be used in place of the roller bearings.

FIG. 15 illustrates an additional embodiment 187 of the second portion 123 of the dressing arm 115. This embodiment has a shorter length L8, which reduces vibration caused by the interaction between the tip-end 107 of the stylus and the grinding surface 51. Otherwise, the embodiment illustrated in FIG. 15 is substantially similar to the dressing arm 115 described above.

Figure 21:
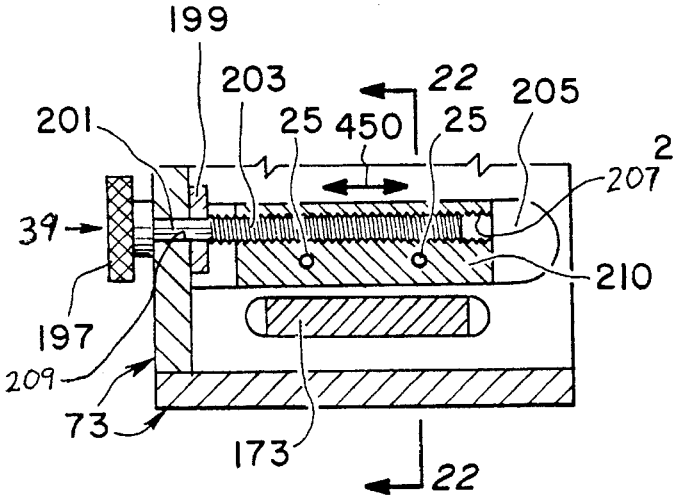
FIG. 21 illustrates an additional embodiment of the mounting member of the dressing assembly.
Figure 22:
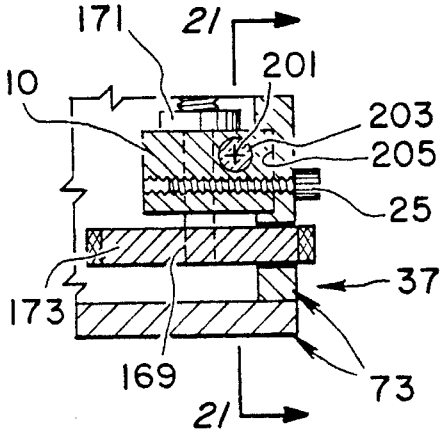
FIG. 22 is a cross-sectional view taken along line 22 of FIG. 21.

FIGS. 21 and 22 illustrate an improvement to the mounting member 153. The improved mounting member 210 is substantially the same as mounting member 153 except that mounting member 210 has an additional threaded hole 207 disposed about an axis 201, which is substantially perpendicular to axes 179 (see FIG. 12). The interior side of the second end 37 of the base 73 is modified to include a slot 205. An additional cylindrical hole 209 has been added to the first side 39 of the base 73 with its axis substantially parallel to and aligned with the axis 201 of the cylindrical hole 207 of the improved mounting member 210 when the improved mounting member 210 is slidably mounted in the slot 205 as shown in FIG. 22. A threaded rod 203 passes through the hole 209 and through a washer 199 to engage the internal threads of the threaded hole 207 of the improved mounting member 210. A knob 197 is mounted to the exterior end of the threaded rod 203. In order to move the first axis 119 of the first portion 117 of the dressing arm 115 in the central plane 53 of the grinding wheel 47, the screws 25 are first loosened, and the knob 197 is turned to move the improved mounting member 210 in the direction 450 (shown in FIG. 21) substantially perpendicular to the central plane 53. Once the improved mounting member 210 has been placed in the desired position, screws 25 are then tightened to lock the improved mounting member 210 into place.

In the preferred embodiment of the blade sharpening system 10 as described above, the central plane 53 of the grinding wheel. 47 is substantially parallel to the central plane 9 of the blade 5. It is also anticipated that the guide means described above and claimed below could be used in a system utilizing a grinding wheel with its central plane 53 perpendicular to the central plane 9 of the blade 5 and with the second axis 56 between the guide surfaces 87. In fact, the guide means of the present invention would be useful in any blade sharpening system where it is necessary to prevent canting and twisting of a blade. Likewise, the dressing means and spring mounting assembly described above could be used alone or together in systems utilizing a rotating grinding wheel with its central plane 53 perpendicular to the central plane 9 of the blade 5.

In summary, a portable sharpener for sharpening the hollow ground edge of an elongated blade of an ice skate has been disclosed herein. The sharpener provides a base 73 or a housing 73 wherein each dimension of the housing 73 is on the order of or less than the length of the elongated blade of the skate. Mounted to the housing 73 is a motor 11 that slides in a predetermined direction. The motor 11 is operatively coupled to a grinding wheel 47, and a biasing mechanism engages the housing to bias the grinding wheel 47 in the predetermined direction of sliding. The grinding wheel 47 has a formed grinding surface 51 that is used to sharpen the hollow ground edge 7 of the blade 5. The location of the motor 11 and grinding wheel 47 with respect to the housing 73 can be in any suitable location provided that the center of the grinding surface for the grinding wheel 47 is located in the proper true position to sharpen the hollow ground edge 7 of the blade 5. To accomplish this, a guide assembly 200 is provided in the housing 73 and includes a first guide member 15 and a second guide member 17 spaced apart from the first guide member 15 to form an elongated slot 31. The formed slot 31 has side walls and a central plane 32 located between the side walls. The center of the grinding surface 51 is positioned in this central plane 32 of the slot 31. A slot width adjuster is provided for adjusting the width of the slot 31 to correspond to the width of the elongated blade 5. Bearings 79 are located in the first 15 and second 17 guide members for providing bearing surfaces 87 in the side walls of the slot. These bearing surfaces 87 provide a sliding fit when the elongated blade 5 is inserted into the slot 31. This prevents the blade 5 from canting and twisting in the slot 31 as the blade 5 is moved through the slot 31 for sharpening. The bias mechanism provides the desired grinding pressure on the blade 5 as the blade 5 is moved through the slot 31. In addition, the dresser assembly 300 is provided in the housing 73 having a grinding tip 107, 111, a mechanism for pivoting the grinding tip 107, 111 in an arc across the formed grinding surface in a desired radius, a radius adjuster for changing the desired radius, and a location adjuster for changing the location of the grinding tip 107, 111 as the grinding surface 51 wears.

While several embodiments of the present invention have been shown and described in detail, it is to be understood that various changes and modifications could be made without departing from the scope of the invention. Accordingly, these and other like modifications and uses of the described system for sharpening ice skate blades are within the spirit and scope of the present invention.

I claim:

1. A system for sharpening an elongated blade of an ice skate, the blade having a narrow width extending outwardly on each side of a first central plane, the system including:

(a) a grinding wheel having a rotational axis and a grinding surface extending outwardly on each side of a second central plane, said grinding wheel further having a center and a second axis passing through the center and lying in said second central plane of said grinding wheel; and (b) means for guiding the blade across the surface of the grinding wheel with said first central plane of the blade substantially aligned with said second axis of said grinding wheel said guiding means including:

(i) at least a first beating surface and a second beating surface; wherein each of the first and second beating surfaces is formed by at least a pair of cylindrical roller beatings, each roller bearing having an axis of rotation and a race with an exterior surface, said exterior surfaces of each pair of roller beatings respectfully forming said first and second bearing surfaces, and wherein said guiding means further includes means for aligning the axes of said roller bearings in parallel, said bearing surfaces formed by said pair of cylindrical roller bearings preventing twisting and canting of said blade, (ii) means for mounting the second beating surface opposite the first bearing surface at a distance spaced therefrom, said second axis of the grinding wheel lying between said bearing surfaces, said mounting means including means for adjusting the distance between the beating surfaces to form a sliding fit between the beating surfaces and the blade when the blade is inserted with the narrow width between the beating surfaces to thereby restrict the blade to sliding movement.

2. The system of claim 1 wherein the central plane of the grinding wheel lies between the bearing surfaces and each bearing surface has at least one roller bearing on each side of said second axis of the grinding wheel.

3. The system of claim 1 wherein each of the first and second bearing surfaces is formed by at least a third cylindrical roller bearing having an axis of rotation and an exterior surface, the axis of rotation of said third cylindrical roller bearing being parallel to the axes of rotation of said pair of roller bearings, said pair of roller bearings having a superposed relationship to said third cylindrical roller bearing, the exterior surfaces of each pair and third cylindrical roller bearing forming each of said first and second bearing surfaces said at least third cylindrical roller bearing preventing canting of said blade.

4. A system for sharpening a blade of an ice skate, the blade having a narrow width extending outwardly on each side of a central plane, the blade having a hollow ground edge, the system including:

(a) a housing;

(b) a grinding wheel having a rotational axis and a grinding surface extending outwardly on each side of a central plane, the central plane being substantially perpendicular to and intersecting the rotational axis, the grinding wheel further having a second axis passing through the intersection of the central plane and the rotational axis, said second axis lying in the central plane, sad grinding wheel movably mounted to said housing;

(c) means for rotating the grinding wheel about the rotational axis; and (d)means for maintaining substantially constant grinding pressure between the hollow ground edge of the blade and the grinding surface of the grinding wheel when the blade is passed across the grinding surface of the rotating grinding wheel with the central plane of the blade substantially aligned with the second axis of the grinding wheel, said pressure-maintaining means including:

(i) means for allowing displacement of the grinding wheel with respect to said housing from a first position to a second position in a direction substantially normal to the surface of the grinding wheel and in the central plane of the grinding wheel;

(ii) means for applying a force to the grinding wheel biasing said grinding wheel toward said first position and away from said second position, said force being substantially proportinal to said displacement of said grinding wheel; and (iii) means for limiting the movement of the blade in the direction of said displacement to a position between said first and second positions; wherein to sharpen the hollow ground edge of the blade, the hollow ground edge is passed across the grinding surface of the grinding wheel with the central plane of the blade substantially aligned with the second axis of the grinding wheel.

5. The system of claim 4 wherein the grinding surface of the grinding wheel is outwardly curved, and wherein the hollow ground edge of the blade is sharpened by passing the hollow ground edge across the outwardly curved grinding surface with the central plane of the blade substantially co-planar with the central plane of the grinding wheel.

6. The system of claim 4 wherein the means for rotating the grinding wheel includes a direct current electric motor, and the system further includes a battery power source to supply electrical power to the electric motor.

7. A system for sharpening a blade of an ice skate, said blade having an edge, the system including:

(a) a grinding wheel having a rotational axis and a grinding surface extending outwardly on each side of a central plane, said central plane being perpendicular to the rotational axis;

(b) an electric motor having a drive shaft;

(c) at least one cylindrical rod having a first end;

(d) a block having at least a first cylindrical hole and at least a second cylindrical hole with the axes of said holes being substantially perpendicular to each other, said first hole of the block having a diameter larger than the diameter of the drive shaft, said second hole of the block having a diameter larger than said rod, the block further having a front side and a back side, the block having the motor mounted thereto with the drive shaft of the motor passing through the first hole in the block and projecting from the front side and with the drive shaft being substantially aligned with and parallel to the axis of the first hole of the block;

(e) means for mounting the grinding wheel to the drive shaft with the rotational axis substantially parallel to the axis of the first hole;

(f) at least one compression spring having an internal diameter larger than the diameter of the rod, a first end, and a second end;

(g) a base having the first end of said rod mounted thereto with the rod passing through the internal diameter of the compression spring, the rod passing through said second hole of the block, the first end of the spring abutting the block and the second end abutting the base, the spring biasing the block away from the base to a first position whereby movement of the block along the rod toward the base to a second position fully compresses the spring said spring being fully compressed in said second position;

(h) means for limiting the movement of the block along the rod to being substantially parallel to the central plane of the grinding wheel; and (i) means for, limiting the movement of the blade in the direction of said displacement to a position between said first and second positions;

wherein the edge is sharpened by moving the edge of the blade to contact the grinding surface of the grinding wheel so as to displace the grinding wheel from the first position toward the second position, said blade contacting said limiting means, said limiting means preventing the displacement of said grinding wheel to said second position and, thereby maintaining substantially constant grinding pressure between the blade, and the grinding wheel.

8. The system of claim 7 wherein the means for rotating the grinding wheel includes a direct current electric motor, and the system further includes a battery power source to supply electrical power to the electric motor.

9. A system for sharpening a blade of an ice skate, the system including:

(a) a grinding wheel with an outwardly curved grinding surface extending outwardly on each side of a central plane; and (b) means for dressing the grinding wheel, said dressing means including:

(i) a stylus having a tip-end and a second end;

(ii) means for moving the tip-end of the stylus in a circular arc in contact with the grinding surface of the grinding wheel, the circular arc lying in a plane substantially perpendicular to the central plane of the grinding wheel, said means for moving the tip-end of the stylus in said circular arc further including:

a dressing attar having first and second portions extending along respective axes substantially parallel to and offset from each other, said first portion of the dressing arm having a bearing surface, and means for securing the stylus to the second portion with the tip-end projecting from the second portion toward the axis of the first portion with a distance between said tip-end and axis of the first portion;

(iii) holder means for rotatably supporting the first portion of the dressing arm at the bearing surface, said holder means further including portions defining a first cylindrical hole extending about a first axis and with an inner bearing surface, the first portion of the dressing arm passing through said first hole with the bearing surface of the dressing arm contacting the inner bearing surface of said first hole, the holder means further including portions defining at least a second cylindrical hole extending about a second axis substantially perpendicular to the first axis of the first cylindrical hole;

(iv) means for moving the axis of the first portion of the dressing arm in a plane substantially co-planar with the central plane of the grinding wheel, said means for moving said axis of said first portion of the dressing arm including at least one cylindrical rod having a first end, a second end, and a diameter smaller than the diameter of said second cylindrical hole of the holder means, the rod passing through said second cylindrical hole; said holder means further including means for restricting the sliding movement of said holder means along said rod to a direction substantially parallel to the second axis of said second cylindrical hole of said holder means; and (v) means for fixing the position of the holder means between the first and second ends, of the rod.

10. The system of claim 9 wherein:

(a) the holder means further includes an interior surface defining at least a third cylindrical hole extending about an axis substantially parallel to the axis of said second cylindrical hole, said interior surface having internal screw threads; and (b) said fixing means further includes:

(i) a threaded rod having a first end, a second end, a threaded portion having external screw threads extending from the second end towards the first end, a non-engaging portion extending from the first end towards the second end, said screw threads frictionally mating the threads of said third hole of the holder means, and (ii) means for rotatably supporting the non-engaging portion of said threaded rod to prevent axial movement of the threaded rod, said supporting means including means to facilitate manual turning of the threaded rod, the turning of the threaded rod exerting a force on the holder means through the threads thereby moving the holder means along the rod and substantially parallel to the axis of said second hole, said frictional mating of the threads fixing the position of the holder means along said first rod.

11. A blade sharpening system intended for sharpening a blade of an ice skate, the blade having a blade-support member supporting an elongated blade of narrow width extending outwardly on each side of a central plane, the blade sharpener including:

(a) a base;

(b) an electric motor having a drive shaft;

(c) a battery power source to supply electrical power to the electric motor;

(d) a grinding wheel rotated by said electric motor about a rotational axis, said grinding wheel having a grinding surface extending outwardly on each side of a central plane perpendicular to the rotational axis;

(e) at least one cylindrical rod having a first end;

(f) a block having at least a first cylindrical hole and at least a second cylindrical hole with the axes of said holes being substantially perpendicular to each other, said first hole of the block having a diameter larger than the diameter of the drive shaft, said second hole of the block having a diameter larger than said rod, the block further having a front side and a back side, the block having the motor mounted thereto with the drive shaft of the motor passing through the first hole in the block and projecting from the front side and with the drive shaft being substantially aligned with and parallel to the axis of the first hole of the block;

(g) means for mounting the grinding wheel to the drive shaft with the rotational axis substantially parallel to the axis of the first hole;

(h) at least one compression spring having an internal diameter larger than the diameter of the rod, a first end, and a second end;

(i) means for mounting said first end of said rod to the base with the rod passing through the internal diameter of the compression spring, the rod passing through said second hole of the block, the first end of the spring abutting the block and the second end abutting the base, wherein movement of the block along the rod toward the base compresses the spring, said mounting means further including means for limiting the movement of the block along the rod to a plane substantially parallel to the central plane of the grinding wheel;

(j) means for limiting the depth of insertion of the blade in the direction of said movement of said block;

(k) means for guiding the blade across the surface of the grinding wheel with the central plane of the blade substantially co-planar with the central plane of said grinding wheel, said guiding means including:

(i) at least a first bearing surface and a second bearing surface, each of the first and second bearing surfaces formed by at least a pair of cylindrical roller bearings, each roller bearing having an axis of rotation and a race with an exterior surface, said exterior surfaces of each pair of roller bearings respectfully forming said first and second bearing surfaces, said guiding means further including means for aligning the axes of said roller bearings in parallel; and (ii) means for mounting to the base the second bearing surface opposite the first bearing surface at a distance spaced therefrom with the central plane of the grinding wheel lying between the bearing surfaces, said mounting means including means for adjusting the distance between the bearing surfaces to form a sliding fit between the bearing surfaces and the blade when the blade is inserted with the narrow width between the bearing surfaces to thereby restrict the blade to sliding movement; and (l) means for dressing the grinding wheel, said dressing means including:

(i) a stylus having a tip-end and a second end;

(ii) a dressing arm having first and second portions extending along respective axes substantially parallel to and offset from each other, and means for securing the stylus to the second portion with the tip-end projecting from the second portion toward the axis of the first portion with a distance between said tip-end and axis of the first portion, said first portion of the dressing arm further including a bearing surface; and (iii) holder means for rotatably supporting the first portion of the dressing arm at the bearing surface, said holder means including portions defining a first cylindrical hole extending about a first axis and with an inner bearing surface, the first portion of the dressing arm passing through said first hole with the bearing surface of the dressing arm contacting the inner bearing surface of said first hole;

wherein the edge is sharpened by inserting said blade between said first and second bearing surfaces and moving the edge of the blade to contact the grinding surface of the grinding wheel so as to displace the grinding wheel toward the base, said blade contacting said means for limiting the depth of insertion so that substantially constant grinding pressure is maintained.

12. A blade sharpening system intended for sharpening a blade of an ice skate, the blade having a blade-support member supporting an elongated blade of narrow width extending outwardly on each side of a central plane, the blade sharpener including:

(a) a base;

(b) an electric motor having a drive shaft;

(c) a battery power source to supply electrical power to the electric motor;

(d) a grinding wheel rotated by said electric motor about a rotational axis said grinding wheel having a grinding surface extending outwardly on each side of a central plane perpendicular to the rotational axis;

(e) at least one cylindrical rod having a first end;

(f) a block having at least a first cylindrical hole and at least a second cylindrical hole with the axes of said holes being substantially perpendicular to each other, said first hole of the block having a diameter larger than the diameter of the drive shaft, said second hole of the block having a diameter larger than said rod, the block further having a front side and a back side, the block having the motor mounted thereto with the drive shaft of the motor passing through the first hole in the block and projecting from the front side and with the drive shaft being substantially aligned with and parallel to the axis of the first hole of the block;

(g) means for mounting the grinding wheel to the drive shaft with the rotational axis substantially parallel to the axis of the first hole;

(h) at least one compression spring having an internal diameter larger than the diameter of the rod, a first end, and a second end;

(i) means for mounting said first end of said rod to the base with the rod passing through the internal diameter of the compression spring, the rod passing through said second hole of the block, the first end of the spring abutting the block and the second end abutting the base, whereby movement of the block along the rod toward the base compresses the spring, said mounting means further including means for limiting the movement of the block along the rod to a plane substantially parallel to the central plane of the grinding wheel;

(j) means for guiding the blade across the surface of the grinding wheel with the central plane of the blade substantially co-planar with the central plane of said grinding wheel, said guiding means including:

(i) at least a first bearing surface and a second bearing surface, each of the first and second bearing surfaces formed by at least a pair of cylindrical roller bearings, each roller bearing having an axis of rotation and a race with an exterior surface, said exterior surfaces of each pair of roller bearings respectfully forming said first and second bearing surfaces, said guiding means further including means for aligning the axes of said roller bearings in parallel; and (ii) means for mounting to the base the second bearing surface opposite the first bearing surface at a distance spaced therefrom with the central plane of the grinding wheel lying between the bearing surfaces, said mounting means including means for adjusting tile distance between the bearing surfaces to form a sliding fit between the bearing surfaces and the blade when the blade is inserted with the narrow width between the bearing surfaces to thereby restrict the blade to sliding movement;

(k) means for dressing the grinding wheel, said dressing means including:

(i) a stylus having a tip-end and a second end;

(ii) a dressing arm having first and second portions extending along respective axes substantially parallel to and offset from each other, and means for securing the stylus to the second portion with the tip-end projecting from the second portion toward the axis of the first portion with a distance between said tip-end and axis of the first portion, said first portion of the dressing arm further including a bearing surface;

(iii) holder means for rotatably supporting the first portion of the dressing arm at the bearing surface, said holder means including portions defining a first cylindrical hole extending about a first axis and with an inner bearing surface, the first portion of the dressing arm passing through said first hole with the bearing surface of the dressing arm contacting the inner bearing surface of said first hole, said holder means further including portions defining at least a second cylindrical hole extending about a second axis substantially perpendicular to the first axis of the first cylindrical hole, and an interior surface defining at least a third cylindrical hole extending about an axis substantially parallel to the axis of said second cylindrical hole, said interior surface having internal screw threads; and (iv) means for fixing the position of the holder means between the first and second ends of the rod, said fixing means further including:

a threaded rod having a first end, a second end, a threaded portion having external screw threads extending from the second end towards the first end, a non-engaging portion extending from the first end towards the second end, said screwy threads frictionally mating the threads of said third hole of the holder means; and means for rotatably supporting the non-engaging portion of said threaded rod to prevent axial movement of the threaded rod, said means including means to facilitate manual turning of the threaded rod, the turning of the threaded rod exerting a force on the holder means through the threads thereby moving the holder means along the rod and substantially parallel to the axis of said second hole, said frictional mating of the threads fixing the position of the holder means along said first rod;

(l) means for adjusting the distance between the axis of the first portion of the dressing arm and the tip-end of the stylus; and (m) means for moving the axis of the first portion of the dressing arm in a plane substantially co-planar with the central plane of the grinding wheel, said means for moving the first axis further including at least one cylindrical rod having a first end, a second end, and a diameter smaller than the diameter of said second cylindrical hole of the holder means, the rod passing through said second cylindrical hole of the holder means, the holder means futher including means for restricting the sliding movement of said holder means along said rod to a direction substantially parallel to the second axis of said second cylindrical hole of said holder means.

13. A portable sharpener for sharpening a hollow ground edge of an elongated blade of an ice skate, said elongated blade having sides equally spaced apart from a central plane, and said elongated blade being mounted to an elongated support on said ice skate, said portable sharpener comprising:

a housing having an exterior, an interior, and first and second ends, said housing having each dimension thereof less than the approximate length of said elongated blade;

a motor mounted between said first and second ends on said exterior of said housing for sliding with respect to said housing in a predetermined direction;

a grinding wheel located in said interior of said housing and operatively coupled to said motor for rotating said grinding wheel in a grinding plane, said grinding wheel having a formed grinding surface for sharpening said hollow ground edge of said elongated blade, the grinding surface having a center located in said grinding plane during said rotation;

a guide assembly connected to said housing for aligning said central plane of said blade with said center of said grinding surface, said guide assembly having:

(a) a first guide member; and (b) a second guide member spaced apart from said first guide member to form an elongated slot, said elongated slot having a central plane, said center of said formed grinding surface being positioned in said central plane of said elongated slot; and (c) a slot width adjustor for adjusting the width of said elongated slot to substantially correspond to the width of said elongated blade;

wherein said elongated support of said ice skate abuts said first and second guide members when said elongated blade is slid through said elongated slot to engage said formed grinding surface with a desired substantially constant grinding pressure in said predetermined direction during sharpening of said elongated blade;

a dresser assembly located in said interior near said first end of said housing for dressing said formed grinding surface of said grinding wheel; and a battery located in said interior near said second end of the housing.

14. The portable sharpener of claim 13 wherein said guide assembly further comprises:

bearings in said first and second guide members for providing bearing surfaces in said slot, said bearing surfaces engaging said sides of said elongated blade in a sliding fit when said elongated blade is slid through said elongated slot so as to prevent said elongated blade from canting and twisting in said elongated slot during sharpening of said elongated blade.

15. The portable sharpener of claim 13 wherein said dresser assembly further comprises:

(a) a grinding tip;

(b) a pivoting mechanism for moving said grinding tip to a predetermined location in an arc of desired radius across said formed grinding surface;

(c) a radius adjustor for changing said desired radius; and (d) a location adjustor for changing said predetermined location of said grinding tip with respect to said formed grinding surface.

16. A portable sharpener for sharpening a hollow ground edge of a blade of an ice skate, said blade having sides, and said blade being mounted to a support on said ice skate, said portable sharpener comprising:

a hand-held housing, said hand-held housing having an exterior, an interior, and first and second ends, said housing having each dimension thereof less than the approximate length of said elongated blade;

a motor mounted to said hand-held housing for sliding with respect to said housing in a predetermined direction;

a grinding wheel located in said interior of said hand-held housing and operatively coupled to said motor for rotating said grinding wheel in a grinding plane, said grinding wheel having a formed grinding surface for sharpening said hollow ground edge of said blade, the center of said formed grinding surface being in said grinding plane during said rotation;

a biasing mechanism engaging said hand-held housing for applying a bias force to continuously bias said grinding wheel in said predetermined direction, said predetermined direction being in the direction of said grinding plane; and a guide assembly connected to said hand-held housing, said guide assembly having:

(a) a first guide member;

(b) a second guide member spaced apart from said first guide member to form a slot, said slot having side walls and a central plane between said side walls, said center of said formed grinding surface being positioned in said central plane of said slot;

(c) a slot width adjustor operative on said first and second guide members for adjusting the width of said slot to correspond to the width of said blade; and (d) bearings in said first and second guide members for providing bearing surfaces in said side walls of said slot, said bearing surfaces engaging said sides of said blade in a sliding fit when said blade is inserted into said slot so as to prevent said blade from canting and twisting in said slot during sharpening of said blade, said support of said ice skate abutting said first and second guide members when said blade is inserted into said slot to engage said formed grinding surface with a desired substantially constant grinding pressure in said predetermined direction against said bias force during sharpening of said blade.

17. The portable sharpener of claim 16 further comprising a dresser assembly connected to said housing for dressing said formed grinding surface of said grinding wheel, said dresser further comprising:

(a) a grinding tip;

(b) a pivoting mechanism for moving said grinding tip to a predetermined location in an arc of desired radius across said formed grinding surface;

(c) a radius adjustor for changing said desired radius; and (d) a location adjustor for changing said predetermined location of said grinding tip with respect to said formed grinding surface.

18. A portable sharpener for sharpening a hollow ground edge of a blade of an ice skate, said blade having sides, said sides having a narrow width, and said blade being mounted to a support on said ice skate, said portable sharpener comprising:

a housing;

a motor mounted to said housing for sliding with respect to said housing in a predetermined direction;

a grinding wheel located in said housing and operatively coupled to said motor for rotating said grinding wheel in a grinding plane, said grinding wheel having a formed grinding surface for sharpening said hollow ground edge of said blade, the center of said formed grinding surface being in said grinding plane during said rotation;

a biasing mechanism engaging said motor and said housing for applying a bias force to continuously bias said motor and said grinding wheel in said predetermined direction, said predetermined direction being in the direction of said grinding plane;

a guide assembly connected to said housing, said guide assembly having a formed slot, said slot having side walls and a central plane between said side walls, said center of said formed grinding surface being positioned in said central plane of the slot;

a slot width adjustor in said guide assembly for adjusting the width of said slot to correspond to the width of said blade;

bearing surfaces located in said side walls of said slot, said bearing surfaces engaging said sides of said blade in a sliding fit when said blade is inserted into said slot so as to prevent said blade from canting and twisting in said slot during sharpening of said blade, said support of said ice skate abutting said guide assembly when said blade is inserted into said slot to engage said formed grinding surface with a desired grinding pressure in said predetermined direction against said bias force during sharpening of said blade; and a dresser assembly connected to said housing for dressing said formed grinding surface of said grinding wheel.

19. A system for sharpening an elongated blade of an ice skate, the blade having a narrow width extending outwardly on each side of a first central plane, the system including:

(a) a grinding wheel having a rotational axis and a grinding surface extending outwardly on each side of a second central plane, said grinding wheel further having a center and a second axis passing through the center and lying in said second central plane of said grinding wheel; and (b) means for guiding the blade across the surface of the grinding wheel with said first central plane of the blade substantially aligned with said second axis of said grinding wheel, said guiding means including:

(i) at least a first bearing surface and a second bearing surface;

(ii) means for mounting the second beating surface opposite the first bearing surface at a distance spaced therefrom, said second axis of the grinding wheel lying between said bearing surfaces, said mounting means including means for adjusting the distance between the bearing surfaces to form a sliding fit between the beating surfaces and the blade when the blade is inserted with the narrow width between the beating surfaces to thereby restrict the blade to sliding movement.

(c) means for mounting the grinding wheel including:

(i) means for allowing displacement with respect to said guiding means of the grinding wheel from a first position to a second position in a direction substantially normal to the surface of the grinding wheel and in the second central plane, said first and second positions separated by a distance;

(ii) means for applying a force to the grinding wheel biasing said grinding wheel toward said first position and away from said second position; and (iii) means for limiting the insertion of the blade in the direction of the displacement of the grinding wheel to a distance less than the distance between said first position and said second position when the narrow width of the blade is inserted between the bearing surfaces, wherein said displacement means, said means for applying a force, and said limiting means maintain substantially constant grinding pressure between the blade and the grinding wheel.

* * * * *